US010254665B2

(12) United States Patent
Zhang et al.

(10) Patent No.: US 10,254,665 B2
(45) Date of Patent: Apr. 9, 2019

(54) ELECTROPHOTOGRAPHIC PHOTORECEPTOR, METHOD FOR MANUFACTURING THE PHOTORECEPTOR, AND ELECTROPHOTOGRAPHIC APPARATUS INCLUDING THE PHOTORECEPTOR

(71) Applicant: FUJI ELECTRIC CO., LTD., Kawasaki-shi (JP)

(72) Inventors: Quanqiu Zhang, Matsumoto (JP); Shinjiro Suzuki, Matsumoto (JP); Fengqiang Zhu, Matsumoto (JP); Masaru Takeuchi, Matsumoto (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 103 days.

(21) Appl. No.: 14/474,794

(22) Filed: Sep. 2, 2014

(65) Prior Publication Data

US 2014/0369715 A1 Dec. 18, 2014

Related U.S. Application Data

(63) Continuation of application No. PCT/JP2012/060784, filed on Apr. 20, 2012.

(51) Int. Cl.
*G03G 5/06* (2006.01)
*G03G 5/05* (2006.01)
(Continued)

(52) U.S. Cl.
CPC ..... *G03G 5/0614* (2013.01); *G03G 5/0564* (2013.01); *G03G 5/0607* (2013.01);
(Continued)

(58) Field of Classification Search
CPC .. G03G 5/0564; G03G 5/0607; G03G 5/0672; G03G 5/0614; G03G 5/0609; G03G 5/043; G03G 5/047
(Continued)

(56) References Cited

U.S. PATENT DOCUMENTS 4,606,988 A 8/1986 Sasaki
5,213,924 A 5/1993 Sakamoto
(Continued)

FOREIGN PATENT DOCUMENTS

CN 101438211 A 5/2009
EP 2410380 A2 1/2012
(Continued)

OTHER PUBLICATIONS

English language machine translation of Morishita Hironobu et al JP 2004-354759 (A)—Dec. 16, 2004 in PDF.*
(Continued)

*Primary Examiner* — Cynthia H Kelly
*Assistant Examiner* — Omar M Kekia
(74) *Attorney, Agent, or Firm* — Rabin & Berdo, P.C.

(57) ABSTRACT

A photoreceptor for electrophotography includes a photosensitive layer provided on a conductive substrate that contains at least a resin binder, a charge transport material, and an additive. The photoreceptor exhibits high photoresponsivity, stable electrical properties regardless of repeated use thereof, and high durability. The resin binder contains a polycarbonate resin composed of a copolymer having structural units expressed by general formulae (1) and (2) below. The charge transport material contains at least one type of stilbene compound expressed by general formulae (3), (4), and (5) below. The additive contains at least one type of diester compound expressed by general formula (6) below.
(Continued)

(1)

(2)

(3)

(4)

(5)

-continued (6)

8 Claims, 2 Drawing Sheets

(51) Int. Cl.
*G03G 5/043* (2006.01)
*G03G 5/047* (2006.01)

(52) U.S. Cl.
CPC ..... *G03G 5/0609* (2013.01); *G03G 5/0672* (2013.01); *G03G 5/043* (2013.01); *G03G 5/047* (2013.01)

(58) Field of Classification Search
USPC ..... 399/159; 430/113, 58.35, 133
See application file for complete search history.

(56) References Cited

U.S. PATENT DOCUMENTS

| | | | | |
|---|---|---|---|---|
| 6,677,091 | B2 * | 1/2004 | Niimi | G03G 5/14704 430/66 |
| 8,354,210 | B2 | 1/2013 | Takaki et al. | |
| 2009/0325096 | A1 * | 12/2009 | Wu | G03G 5/0535 430/58.85 |
| 2010/0028791 | A1 * | 2/2010 | Takaki | G03G 5/0517 430/59.1 |
| 2010/0330474 | A1 | 12/2010 | Fujiwara et al. | |
| 2011/0059393 | A1 * | 3/2011 | Tamoto | G03G 5/0614 430/56 |
| 2012/0022293 | A1 | 1/2012 | Nakamura et al. | |
| 2012/0301182 | A1 * | 11/2012 | Anezaki | G03G 5/056 399/111 |
| 2013/0022904 | A1 | 1/2013 | Zhu et al. | |
| 2013/0040234 | A1 | 2/2013 | Zhang et al. | |
| 2013/0316278 | A1 | 11/2013 | Zhu et al. | |

FOREIGN PATENT DOCUMENTS

| | | | |
|---|---|---|---|
| JP | S59-216853 | A | 12/1984 |
| JP | S60-175052 | A | 9/1985 |
| JP | S61-62040 | A | 3/1986 |
| JP | H03-273256 | A | 12/1991 |
| JP | H04-179961 | A | 6/1992 |
| JP | H08-95264 | A | 4/1996 |
| JP | 2004-085644 | A | 3/2004 |
| JP | 2004-354759 | A | 12/2004 |
| JP | 2006-337633 | A | 12/2006 |
| JP | 2007-279446 | A | 10/2007 |
| JP | 2009-008957 | A | 1/2009 |
| JP | 2012-027139 | A | 2/2012 |
| WO | WO-2011/093410 | A1 | 8/2011 |
| WO | WO-2011/108064 | A1 | 9/2011 |
| WO | WO-2012/077206 | A1 | 6/2012 |

OTHER PUBLICATIONS

English language machine translation of Takagi Ikuo et al. In JP 2007-279446 (A)—Oct. 25, 2017 in PDF.*

* cited by examiner

ELECTROPHOTOGRAPHIC PHOTORECEPTOR, METHOD FOR MANUFACTURING THE PHOTORECEPTOR, AND ELECTROPHOTOGRAPHIC APPARATUS INCLUDING THE PHOTORECEPTOR

CROSS-REFERENCE TO RELATED APPLICATION(S)

This non-provisional application is a continuation of and claims the benefit of the priority of Applicants' earlier filed PCT Application No. PCT/JP2012/060784 filed Apr. 20, 2012, the entire contents of which are incorporated herein by reference.

BACKGROUND OF THE INVENTION

1. Field of the Invention

The present invention relates to a photoreceptor for electrophotography (simply referred to as "photoreceptor," hereinafter) for use in electrophotographic printers, copiers, facsimile machines and the like, a method for manufacturing the photoreceptor for electrophotography, and an electrophotographic apparatus. More particularly, the present invention relates to a photoreceptor for electrophotography that exhibits excellent wear resistance, photoresponsivity, and gas resistance by having a combination of a resin binder, a charge transport material, and an additive having specific structures, a method for manufacturing such photoreceptor for electrophotography, and an electrophotographic apparatus.

2. Description of the Related Art

A photoreceptor for electrophotography has a fundamental structure in which a photosensitive layer with a photoconductive function is placed on a conductive substrate. In recent years, research and development has been actively carried out on organic photoreceptors for electrophotography that use organic compounds as functional components responsible for the generation and transportation of charges, in view of advantages such as the diversity of materials, high productivity and safety, and application of such organic photoreceptors to copying machines, printers and the like is underway.

In general, photoreceptors are required to have a function of retaining surface charges in a dark place, a function of receiving light and generating charges, and a function of transporting the generated charges. Such photoreceptors are classified into so-called single layer type photoreceptors which have a single layer of photosensitive layer with a combination of these functions, and so-called laminated type photoreceptors (function-separated type) which include functionally separated layers such as a charge generation layer that is mainly in charge of generating charges at the time of light reception, a charge transport layer that is in charge of retaining surface charges in a dark place and transporting the charges generated in the charge generation layer at the time of light reception, and a photosensitive layer.

The photosensitive layer is generally formed by applying, on a conductive substrate, coating liquid prepared by dissolving or dispersing a charge generating material, a charge transport material and a resin binder in an organic solvent. In these organic photoreceptors for electrophotography, particularly in the layer that serves as the outermost surface, polycarbonate is often used as the resin binder. This is because polycarbonate is strongly resistant to the friction that occurs between the layer and paper or a blade for toner removal, has excellent flexibility, and has good permeability of exposure light. Among others, bisphenol Z type polycarbonate is widely used as the resin binder. Technologies of using such a polycarbonate as a resin binder are described in, for example, Japanese Patent Application Publication No. S61-62040 (Patent Document 1) and the like. In addition to the above, various studies on polycarbonate structures have been implemented to date for the purpose of enhancing wear resistance, but no satisfactory structures have been developed yet.

Meanwhile, with the recent increase in the number of prints resulting from the networking in offices and the rapid development of light printers due to electrophotography, higher durability, higher sensitivity, and faster responsiveness have been required for the electrophotographic printers. Moreover, the electrophotographic printers are strongly demanded to have less fluctuations in image characteristics which are usually caused by the ozone, NOx or other gas in the printers and by changes in the usage environment (room temperature and humidity).

In addition, with recent color printers being further advanced technically and becoming more common, the increase in print speed, the reduction in printer size, and the reduction in the number of printer components have been implemented. Along with this, color printers are required to be compatible with a wider range of usage. In color printers, stronger transfer currents have had to be used because a process of transferring overlapped toners and a transfer belt have been employed; thus, when performing printing on sheets of various sizes, the difference in transfer burden occurs between the paper sizes and between the sheets, resulting in an increase in the difference in image density. In other words, in case of printing on a large number of small sheets, the photoreceptor portion through which the sheets do not pass (non-passage portion) is constantly under a direct impact of transfer, compared to the photoreceptor part through which the sheets pass (passage portion), increasing the transfer burden. Due to this difference in transfer burden between the passage portion and the non-passage portion, a potential difference is generated in the developer when printing is performed subsequently on large sheets, creating a density difference. This tendency becomes more significant as the transfer current increases. Under such circumstances, compared to monochrome printers, the color printers in particular have less fluctuations in image characteristics and electrical properties which are caused due to repeated use or changes in usage environment (room temperature and humidity), and the demand for the photoreceptor with excellent transfer recoverability has been stronger. Therefore, the conventional technologies, unfortunately, cannot sufficiently fulfill such demand.

In order to improve wear resistance of a negatively-charged laminated-type photoreceptor, it is necessary to increase the ratio of a resin binder contained in a charge transport layer configuring the outermost layer. In so doing, the charge mobility of a charge transport material drops as a result of relatively reducing the ratio of the charge transport material. The charge mobility of the charge transport material needs to be improved, in order to solve this problem. In addition, with the compatibility between the resin binder and the charge transport material in mind, not only is it necessary to select a combination of a resin binder and a charge transport material, but also the ratios thereof need to be adjusted.

Ozone has widely been known as the gas generated in an electrophotographic apparatus. Ozone is generated by a charge that performs corona discharge or a roller charger. When the photoreceptor is exposed to the ozone remaining or accumulating in the apparatus, the organic substances configuring the photoreceptor are oxidized, destroying the original structure and significantly deteriorating the properties of the photoreceptor. The ozone also oxidizes the nitrogen in the air, producing NOx, which is considered to degenerate the organic substances configuring the photoreceptor.

Such degradation of the properties of the photoreceptor caused by the gas involves invasion of the outermost layer of the photoreceptor and an adverse effect caused by the gas flowing into the photosensitive layer. The outermost layer of the photoreceptor could be scraped off by friction between the outermost layer and the various members described above, depending on the degree. However, the harmful gas flowing into the photosensitive layer can destroy the structures of the organic substances of the photosensitive layer. Thus, it is important to consider a way to prevent the harmful gas from flowing into the photosensitive layer. Especially in a tandem system color electrophotographic apparatus using a plurality of photoreceptors, when gas affects the photoreceptors of the apparatus differently depending on where the photoreceptors are installed, fluctuations in color tones occur, interfering with proper generation of images. Such degradation of the properties of the photoreceptor in a tandem system color electrophotographic apparatus, therefore, is a particularly critical issue.

In some cases, the surface of the photoreceptor is contaminated by ozone, nitrogen oxides and the like that are generated at the time of charging the photoreceptor. When this happens, there are problems such as image bleeding due to the contaminants themselves, a decrease in lubricity of the surface of the photoreceptor caused by adhering materials, easy adhesion of paper dust and toner, squealing and peeling of the blade, and the susceptibility of the surface to scratches.

Various improvement technologies for the outermost layers of photoreceptors have been proposed for the purpose of solving these problems.

Various polycarbonate resin structures have been proposed for the purpose of improving the durability of a photoreceptor surface. Japanese Patent Application Publication Nos. 2004-354759 and H4-179961 (Patent Documents 2 and 3), for example, each propose polycarbonate resin having a specific structure, but do not take into enough consideration the compatibility between various charge transport materials and additives, as well as the solubility of the resin. Japanese Patent Application Publication No. 2004-85644 (Patent Document 4) also proposes polycarbonate resin having a specific structure. However, resin with a bulky structure has a lot of spaces between polymers, and, for example, discharged substances upon charging, contact members, or foreign matters may easily penetrate into the photosensitive layer, hence it difficult to obtain sufficient durability. In addition, Japanese Patent Application Publication No. H3-273256 (Patent Document 5) proposes polycarbonate having a special structure that is configured to improve printing durability and coatability, but does not provide enough description of a charge transport material or an additive to be combined, bringing about a problem in which stable electric properties cannot be maintained when the apparatus is used for a long time.

Various charge transport materials with high responsivity and high carrier mobility have been proposed as well. For example, Japanese Patent Application Publication No. S59-216853 (Patent Document 6) proposes a stilbene derivative, and Japanese Patent Application Publication No. 2012-27139 (Patent Document 7) a tris(4-styrylphenyl) amine derivative and the like. These patent documents, however, do not take into enough consideration resin binders or additives to be combined with the charge transport materials, and it has not been possible yet to comply with a change in operating environments, maintain the electrical properties of the photoreceptors used for a long time, improve wear resistance, and mainten contamination resistance.

For the purpose of improving gas resistance, various additives have been proposed, such as hindered phenol compounds, phosphorus-based compounds, sulfer-based compounds, amine-based compounds, hindered amine compounds. Unfortunately, the reality is that these technologies cannot obtain a photoreceptor having sufficient gas resistance or cannot accomplish satisfactory results regarding the electrical properties such as responsivity, image memories, and potential stability at the time of printing, depending on the combination of resin and the charge transport material, even if satisfactory characteristics are exercised for the gas resistance. On the other hand, the applicants propose diester compounds in WO2011/108064 and Japanese Patent Application Publication No. 2007-279446 (Patent Documents 8 and 9) and have been studying a more appropriate combination of a resin binder and a highly mobile charge transport material.

Various types of technologies for improving the surface layers of the photoreceptors have been proposed, as described above. Unfortunately, the technologies described in these patent documents are not satisfactory in all aspects of electrical properties such as photoresponsivity, wear resistance, solvent crack resistance and the like.

An object of the present invention, therefore, is to provide a photoreceptor for electrophotography that exhibits high photoresponsivity, stable electrical properties, and high durability even when used repeatedly. More specifically, an object of the present invention is to provide a photoreceptor for electrophotography of excellent wear resistance, responsivity, and gas resistance by having a combination of a resin binder, a charge transport material, and an additive having specific structures, a method for manufacturing such a photoreceptor for electrophotography, and an electrophotographic apparatus.

SUMMARY OF THE INVENTION

As a result of the earnest research into photosensitive layer compositions, the inventors have discovered that a photoreceptor for electrophotography with improved durability, high photoresponsivity, and excellent electrical properties can be realized by combining a resin binder with a specific charge transport material and a specific additive, the resin binder being polycarbonate having a specific structural unit. Thus, the inventors completed the present invention.

In other words, a photoreceptor for electrophotography according to the present invention is a photoreceptor for electrophotography, comprising a conductive substrate; and a photosensitive layer that is provided on the conductive substrate and that contains at least a resin binder; a charge transport material; and an additive, wherein the resin binder contains a polycarbonate resin comprised of a copolymer having structural units expressed by general formulae (1) and (2) below; the charge transport material is comprised of at least one type of stilbene compound expressed by general formulae (3), (4), and (5) below, and the additive contains at least one type of diester compound expressed by general formula (6) below:

(1)

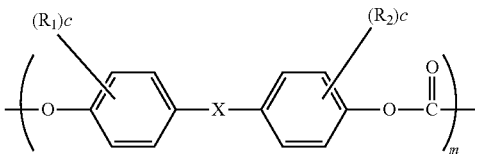

(2)

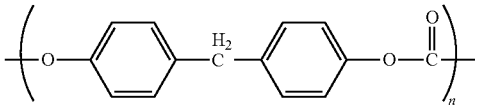

where, in general formula (1), $R_1$ and $R_2$ may be identical or different and each represents a hydrogen atom, an alkyl group having 1 to 12 carbon atoms, a halogen atom, a substituted or non-substituted aryl group having 6 to 12 carbon atoms, or an alkoxy group having 1 to 12 carbon atoms, c is an integer of 0 to 4, X is a single bond, —O—, —S—, —SO—, —CO—, —$SO_2$—, or —$CR_3R_4$— (in which $R_3$ and $R_4$ may be identical or different and each of which represents a hydrogen atom, an alkyl group having 1 to 12 carbon atoms, a halogenated alkyl group, or a substituted or non-substituted aryl group having 6 to 12 carbon atoms), a substituted or non-substituted cycloalkylidene group having 5 to 12 carbon atoms, a substituted or non-substituted a w alkylene group having 2 to 12 carbon atoms, a -9,9-fluorenylidene group, a substituted or non-substituted arylene group having 6 to 12 carbon atoms, or a bivalent radical containing an aryl group or arylene group having 6 to 12 carbon atoms, and m, n represent mole fractions of monomers, respectively, (3)

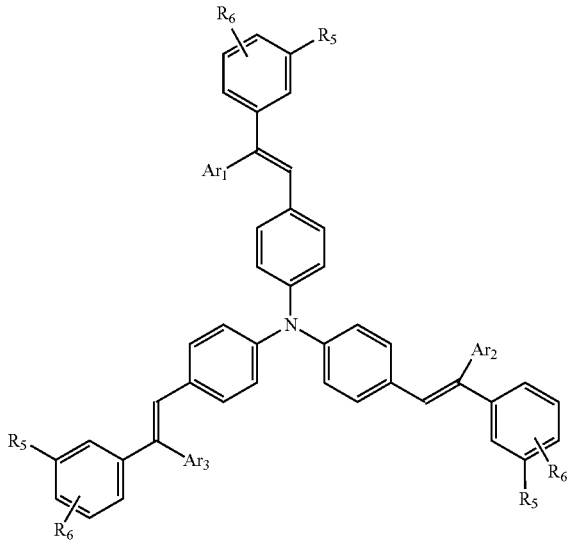

where, in general formula (3), $R_5$ and $R_6$ may be identical or different and each represents a hydrogen atom, a substituted or unsubstituted alkyl group, or a methoxy group, and $Ar_1$, $Ar_2$, and $Ar_3$ may also be identical or different, each of which represents a hydrogen group or a substituted or unsubstituted aryl group, (4)

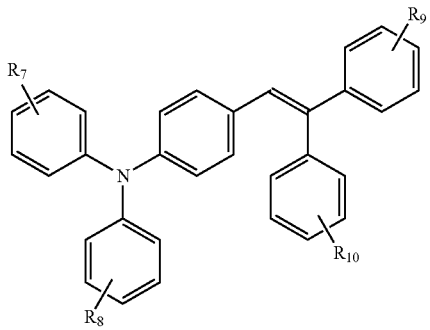

where, in the general formula (4), $R_7$, $R_8$, $R_9$, and $R_{10}$ may be identical or different and each represents a hydrogen atom or a substituted or unsubstituted alkyl group, (5)

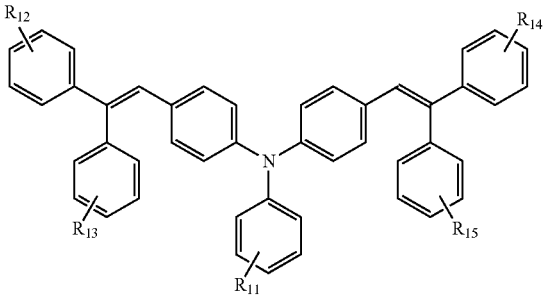

where, in the general formula (5), $R_{11}$, $R_{12}$, $R_{13}$, $R_{14}$, and $R_{15}$ may be identical or different and each represents a hydrogen atom or a substituted or unsubstituted alkyl group, (6)

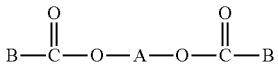

where, in general formula (6), A is any organic group represented by formula (7) below, and B is any organic group represented by formula (8) below, (7)

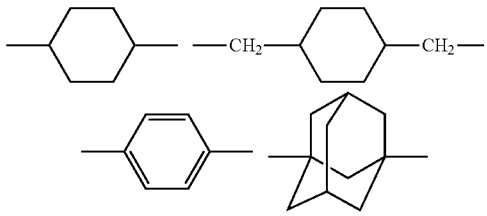

(8)

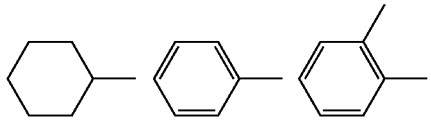

-continued

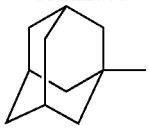

In the present invention, it is preferred that the photosensitive layer is configured as the outermost layer of the photoreceptor. Also in the present invention, the photosensitive layer is preferably configured by sequentially stacking a charge generation layer and a charge transport layer, the charge transport layer containing the polycarbonate resin, the stilbene compound, and the diester compound. Furthermore, in the photoreceptor according to the present invention, it is preferred that $R_1$ and $R_2$ in general formula (1) each represent a hydrogen atom or a methyl group independently, and that X is a cyclohexylidene group. Furthermore, in the photoreceptor according to the present invention, the copolymer has a copolymer ratio of the structural unit expressed by general formula (1) to the structural unit expressed by general formula (2) such that for the copolymer is preferably equal to or greater than 15 mol % but equal to or less than 90 mol %. Moreover, the content of the diester compound is preferably 0.05 to 20% by mass, relative to the total amount of a solid content of the photosensitive layer.

A method for manufacturing a photoreceptor for electrophotography according to the present invention described above is a method comprising: providing a coating liquid comprised of polycarbonate resin comprising a copolymer having structural units expressed by general formulae (1) and (2) below; at least one type of stilbene compound expressed by general formulae (3), (4), and (5) below; and at least one type of diester compound expressed by general formula (6) below; and applying the coating liquid onto a conductive substrate to form a photosensitive layer.

An electrophotographic apparatus according to the present invention is mounted with the photoreceptor for electrophotography according to the present invention.

With use of polycarbonate resin with the specific structural units as a resin binder of a photosensitive layer and with use of a combination of a specific charge transport material and a specific additive, the present invention can realize a photoreceptor that has excellent photoresponsivity, gas resistance, and solvent crack resistance and favorable environmental characteristics while maintaining its electrophotographic characteristics.

DETAILED DESCRIPTION OF THE INVENTION

Embodiments of the present invention are described in detail hereinafter with reference to the drawings. The present invention is not construed as being limited to the following descriptions.

Figure 1A:
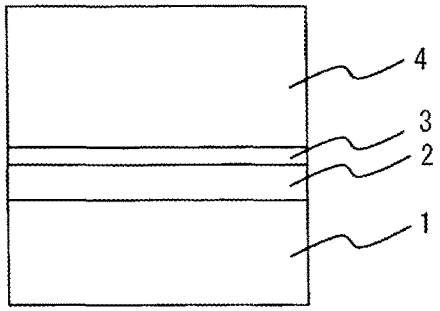
FIGS. 1A to 1C are schematic cross-sectional diagrams each showing an example of a photoreceptor for electrophotography of the present invention.
Figure 1B:
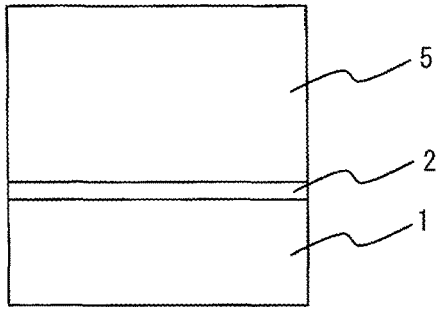
Figure 1C:
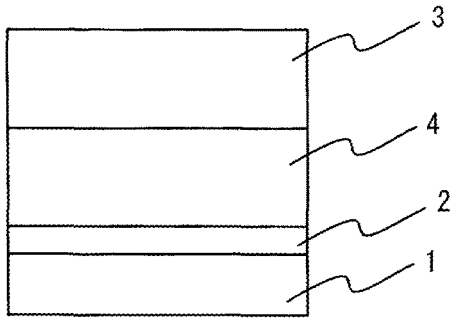

A photoreceptor for electrophotography is classified broadly into a laminated-type (function-separated) photoreceptor with so-called a negatively-charged laminated-type photoreceptor and a positively-charged laminated-type photoreceptor, and a single layer type photoreceptor for positive charging. FIG. 1 is a schematic cross-sectional diagram showing a photoreceptor for electrophotography according to an example of the present invention, where FIG. 1(A) shows a negatively-charged laminated-type photoreceptor for electrophotography, FIG. 1(B) a positively-charged single layer type photoreceptor for electrophotography, and FIG. 1(C) a positively-charged laminated-type photoreceptor for electrophotography. As shown in the diagram, in the negatively-charged laminated-type photoreceptor, an undercoating layer 2 and a photosensitive layer having a charge generation layer 3 with a charge generation function, and a charge transport layer 4 with a charge transport function, are stacked sequentially on a conductive substrate 1. In the positively charged single layer type photoreceptor, on the other hand, the undercoating layer 2 and a photosensitive layer 5 of a single layer type that functions to generate a charge and transport a charge, are stacked sequentially on the conductive substrate 1. Furthermore, in the positively-charged laminated-type photoreceptor, the undercoating layer 2, the charge transport layer 4 with a charge transport function, and a photosensitive layer having the charge generation layer 3 with a charge generation function and a charge transport function, are stacked sequentially on the conductive substrate 1. The undercoating layer 2 may be provided as required in any type of photoreceptor. The term "photosensitive layer" in the present invention means both a laminated-type photosensitive layer with a charge generation layer and a charge transport layer stacked on each other, and a single layer type photosensitive layer.

In the photoreceptor according to the present invention, the photosensitive layer is characterized in containing at least a resin binder, a charge transport material, and an additive, wherein the resin binder includes polycarbonate resin consisting of a copolymer of the structure unit expressed by the foregoing general formula (1) and the structure unit expressed by the foregoing general formula (2), the charge transport material includes at least one type of stilbene compounds expressed by the foregoing general formulae (3), (4) and (5), and the additive includes at least one type of diester compounds expressed by the foregoing general formula (6). The anticipated effects of the present invention can thus be accomplished. The present invention is particularly more effective when a photosensitive layer containing the polycarbonate resin, the stilbene compound, and the diester compound is the outermost surface of the photoreceptor.

The photoreceptor of the present invention may have at least a photosensitive layer on a conductive substrate, but is preferably a laminated-type photoreceptor in which a photosensitive layer has at least a charge generation layer and a charge transport layer. The photoreceptor of the present invention therefore is preferably a negatively-charged laminated-type photoreceptor in which a charge generation layer and a charge transport layer are stacked sequentially on a conductive substrate as shown in FIG. 1, wherein the charge transport layer configuring the outermost surface of the photoreceptor includes polycarbonate resin, a stilbene compound, and a diester compound with the specific structures described above.

Negatively-Charged Laminated-Type Photoreceptor:

The conductive substrate 1 serves as an electrode of its photoreceptor and as a support for the various layers configuring the photoreceptor, and may be in the shape of a cylinder, a plate, a film, or the like. Metals such as aluminum, stainless steel, and nickel, or glass, resin and the like, whose surface is conductive-treated, can be used as the material of the conductive substrate 1.

The undercoating layer 2 is configured by a layer containing resin as the main component or a metal oxide film formed from alumite or the like. The undercoating layer 2 is provided according to need, in order to control the ability to inject charges from the conductive substrate 1 into the photosensitive layer, or for the purposes of covering the defects on the surface of the conductive substrate 1, enhancing the adhesiveness between the photosensitive layer and the conductive substrate 1, and the like. Examples of the resin material used for the undercoating layer 2 include insulating polymers such as casein, polyvinyl alcohol, polyamide, melamine, and cellulose; and conductive polymers such as polythiophene, polypyrrole, and polyaniline. These resins can be used alone or in appropriate combinations and mixtures. In addition, these resins may contain metal oxides such as titanium dioxide and zinc oxide.

The charge generation layer 3 is formed by a method such as application of coating liquid in which particles of a charge generating material are dispersed in a resin binder. The charge generation layer 3 receives light to generate charges.

It is preferred that the charge generation layer 3 have a charge generating function; thus, the film thickness thereof is determined from the optical absorption coefficient of the charge generating material. The film thickness is generally 1 μm or less, and preferably 0.5 μm or less. In regard to the charge generation layer 3, a charge generating material can be used as the principal material, and a charge transport material and the like can be added thereto.

The charge transport layer 4 is composed mainly of a resin binder, a charge transport material, and an additive. In the present invention a copolymerized polycarbonate resin having the structural units expressed by the general formulae (1) and (2) needs to be used as the resin binder of the charge transport layer 4. Specific examples of the copolymer having the structural units expressed by the general formulae (1) and (2) are shown below. However, the copolymerized polycarbonate resin according to the present invention is not limited to those with the following structures. Note, in the following formulae, that the ratio between m and n is selected in a manner that the m is normally 15 to 90 mol %, preferably 25 to 75 mol %, and more preferably 30 to 60 mol %, relative to the total amount of 100 mol % of the m and the n.

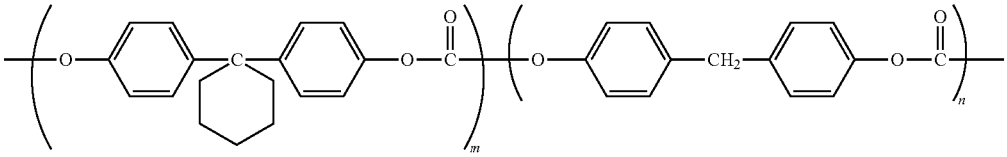

Furthermore, it is important that the charge generation layer 3 have high charge generation efficiency and an ability to inject the generated charges into the charge transport layer 4, and it is desirable that the charge generation layer 3 is less dependent on the electric field and is effective in injection even at low electric fields.

Examples of the charge generating material include phthalocyanine compounds such as X-type metal-free phthalocyanine, τ-type metal-free phthalocyanine, α-type titanyl phthalocyanine, β-type titanyl phthalocyanine, Y-type titanyl phthalocyanine, γ-type titanyl phthalocyaine, amorphous titanyl phthalocyanine, and ε-type copper phthalocyanine; various azo pigments, anthanthrone pigments, thiapyrylium pigments, perylene pigments, perinone pigments, squarylium pigments, and quinacridone pigments, and these compounds can be used alone or in appropriate combinations. Favorable substances can be selected in accordance with the light wavelength region of the exposure light source used in image formation. The content of the charge generating material in the charge generation layer 3 is preferably 80 to 20% by mass, and more preferably 30 to 70% by mass, relative to the solid content of the charge generation layer 3.

Examples of the resin binder of the charge generation layer 3 include polymers and copolymers of polycarbonate resin, polyester resin, polyamide resin, polyurethane resin, vinyl chloride resin, vinyl acetate resin, phenoxy resin, polyvinyl acetal resin, polyvinyl butyral resin, polystyrene resin, polysulfone resin, diallyl phthalate resin, and methacrylic acid ester resin, which can be used in appropriate combinations. The content of the resin binder in the charge generation layer 3 is preferably 20 to 80% by mass, and more preferably 30 to 70% by mass, relative to the solid content of the charge generation layer 3.

The viscosity average molecular weight of the polycarbonate resin according to the present invention is preferably 10,000 to 100,000, more preferably 20,000 to 70,000, and yet more preferably 40,000 to 60,000.

In the present invention the copolymerized polycarbonate resin may be used alone as the resin binder of the charge transport layer 4 or may be mixed with other resin. Examples of such resin include various polycarbonate resins other than the foregoing copolymerized polycarbonate resin, such as bisphenol A type, bisphenol Z type, a bisphenol A type-biphenyl copolymer, a bisphenol Z type-biphenyl copolymer; polyphenylene resins, polyester resins, polyvinyl acetal resins, polyvinyl butyral resins, polyvinyl alcohol resins, vinyl chloride resins, vinyl acetate resins, polyethylene resins, polypropylene resins, acrylic resins, polyurethane resins, epoxy resin, melamine resins, silicone resins, polyamide resins, polystyrene resins, polyacetal resins, other polyarylate resins, polysulfone resins, polymers of methacrylic acid esters, and copolymers of these polymers. It is also acceptable to mix and use resins of the same kind which have different molecular weights.

The content of the resin binder in the charge transport layer 4 is preferably 10 to 90% by mass, and more favorably 20 to 80% by mass, relative to the solid content of the charge transport layer 4.

At least one type of stilbene compound expressed by general formulae (3), (4) and (5) needs to be used as the charge transport material of the charge transport layer 4. The following shows examples of the structures of the stilbene compounds expressed by the general formulae (3), (4) and (5) according to the present invention. However, the compounds used in the present invention are not limited thereto.

(3-1)
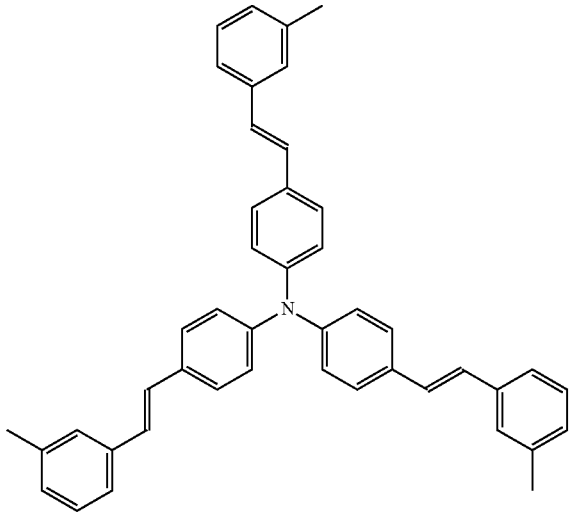
(3-2)
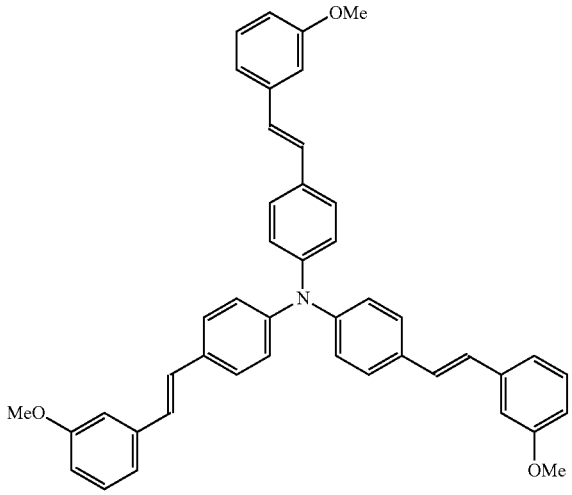
(3-3)
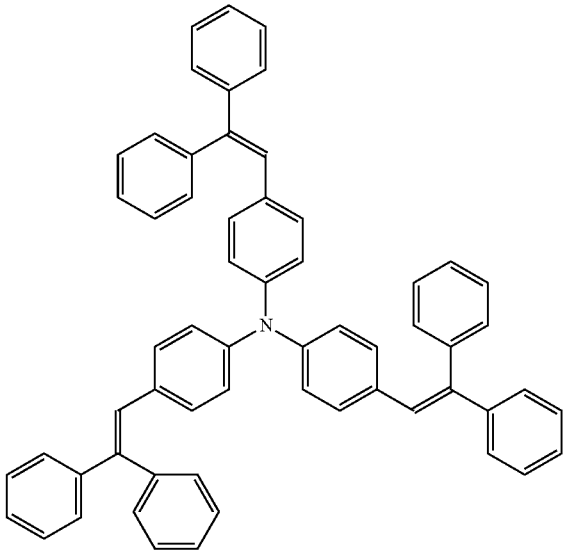
-continued
(4-1)
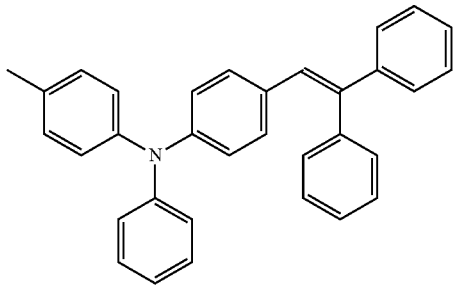
(4-2)
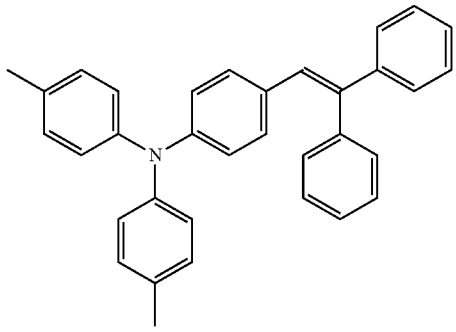
(4-3)
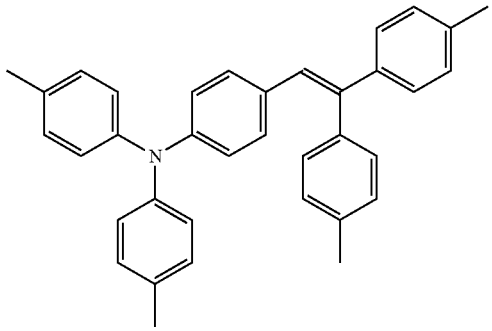
(5-1)
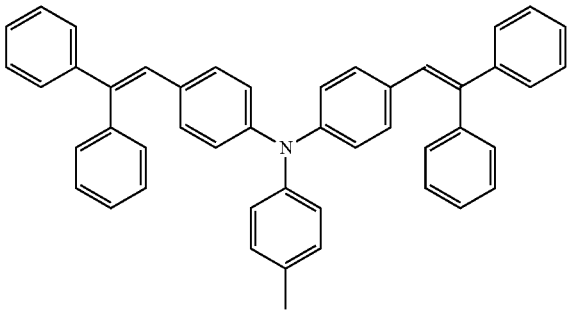
(5-2)
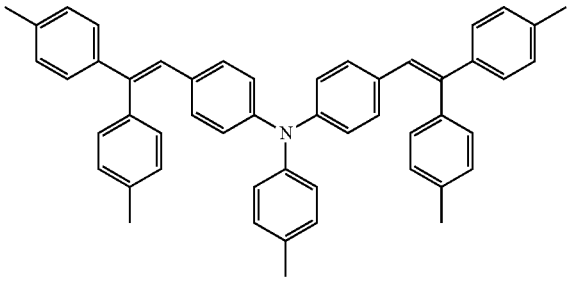

The content of the charge transport material in the charge transport layer 4 is preferably 10 to 90% by mass, more preferably 20 to 80% by mass, and yet more preferably 30 to 60% by mass, relative to the solid content of the charge transport layer 4.

Examples of the charge transport material of the charge transport layer 4 include the stilbene compound expressed by the general formula (3), (4) or (5), hydrazone compounds, pyrazoline compounds, pyrazolone compounds, oxadiazole compounds, oxazole compounds, arylamine compounds, benzidine compounds, other stilbene compounds, styryl compounds, poly-N-vinylcarbazole, and polysilanes. These materials can be used in appropriate combinations. When used in combination with the stilbene compound of the general formula (3), (4) or (5) in the charge transport layer 4, the content of these charge transport material is preferably 0 to 90% by mass, more preferably 0 to 80% by mass, and yet more preferably 10 to 80% by mass, relative to the stilbene compound expressed by the general formula (3), (4) or (5).

The diester compound expressed by the foregoing general formula (6) needs to be used as the additive of the charge transport layer 4. Shown below are examples of the structures of the diester compound expressed by the general formula (6) according to the present invention. However, the compounds used in the present invention are not limited thereto.

(6-1)

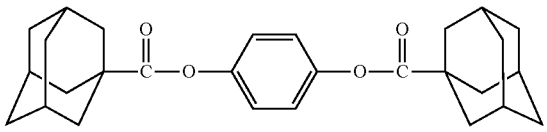

(6-2)

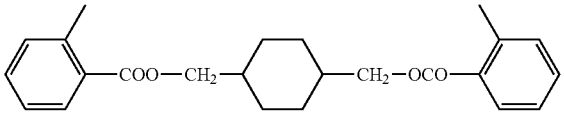

(6-3)

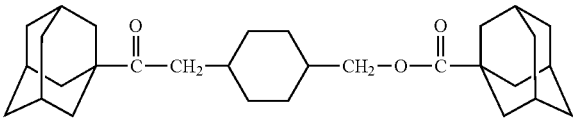

(6-4)

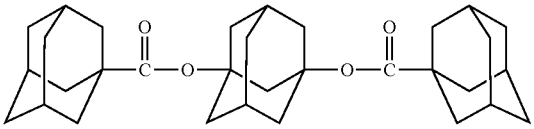

The content of the additive in the charge transport layer 4 is preferably 0.05 to 20% by mass, more preferably 0.1 to 20% by mass, yet more preferably 0.5 to 10% by mass, and particularly preferably 5 to 10% by mass, relative to the solid content of the charge transport layer 4.

Note that the film thickness of the charge transport layer 4 is s preferably in the range of 3 to 50 μm, and more preferably in the range of 15 to 40 μm, in order to maintain the practically effective surface potential.

Single Layer Type Photoreceptor:

In the present invention the photosensitive layer 5 of a single-layer type is composed mainly of a charge generating material, a hole transport material, an electron transport material (acceptor compound), and a resin binder.

Examples of the charge generating material that can be used include phthalocyanine-based pigments, azo pigments, anthanthrone pigments, perylene pigments, perinone pigments, polycyclic quinone pigments, squarylium pigments, thiapyrylium pigments, and quinacridone pigments. These charge generating materials can be used alone, or two or more kinds thereof can be used in combination. Particularly, for the photoreceptor for electrophotography of the present invention, a disazo pigment and a trisazo pigment are preferred as azo pigments, N,N'-bis(3,5-dimethylphenyl)-3,4:9,10-perylene-bis(carboxyimide) as a perylene pigment, and metal-free phthalocyanine, copper phthalocyanine, and titanyl phthalocyanine as phthalocyanine-based pigments. Furthermore, the use of X-type metal-free phthalocyanine, τ-type metal-free phthalocyanine, ε-type copper phthalocyanine, α-type titanyl phthalocyanine, β-type titanyl phthalocyanine, Y-type titanyl phthalocyanine, amorphous titanyl phthalocyanine, and the titanyl phthalocyanines described in Japanese Patent Application Publication No. H8-209023, U.S. Pat. No. 5,736,282 and U.S. Pat. No. 5,874,570 that have a Bragg angle 2θ of 9.6° as the maximum peak in the CuKα: X-ray diffraction spectroscopy, shows the effect of significant improvements in sensitivity, durability and image quality. The content of the charge generating material is preferably 0.1 to 20% by mass, and more favorably 0.5 to 10% by mass, relative to the solid content of the single layer type photosensitive layer 5.

At least one type of stilbene compound expressed by general formulae (3), (4) and (5) needs to be used as the hole transport material. In addition, examples of the hole transport material include hydrazone compounds, pyrazoline compounds, pyrazolone compounds, oxadiazole compounds, oxazole compounds, arylamine compounds, benzidine compounds, other stilbene compounds, styryl compounds, poly-N-vinylcarbazole, and polysilanes. These hole transport materials can be used alone or in appropriate combinations. Preferred as the hole transport material used in the present invention are compounds having an excellent ability to transport the holes that are generated at the time of light irradiation, as well as compounds that are suitable for mixing with a charge generating material. The content of the hole transport material is preferably 3 to 80% by mass, and more preferably 5 to 60% by mass, relative to the solid content of the single layer type photosensitive layer 5.

Examples of the electron transport material (acceptor compound) include succinic anhydride, maleic anhydride, dibromosuccinic anhydride, phthalic anhydride, 3-nitrophthalic anhydride, 4-nitrophthalic acid anhydride, pyromellitic acid anhydride, pyromellitic acid, trimellitic acid, trimellitic anhydride, phthalimide, 4-nitrophthalimide, tetracyanoethylene, tetracyanoquinodimethane, chloranyl, bromanyl, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyrane-based compounds, quinone-based compounds, benzoquinone compounds, diphenoquinone-based compounds, naphthoquinone-based compounds, anthraquinone-based compounds, stilbenequinone-based compounds, and azoquinone-based compounds. These electron transport materials can be used alone, or two or more kinds thereof can be used in combination. The content of the electron transport material is preferably 1 to 50% by mass, and more preferably 5 to 40% by mass, relative to the solid content of the single layer type photosensitive layer 5.

In the present invention, a copolymerized polycarbonate resin having a structural unit expressed by the general formulae (1) and (2) needs to be used as a resin binder for the single layer type photosensitive layer 5. Examples of this copolymerized polycarbonate resin include the same compounds as those described above.

As the resin binder of the single layer type photosensitive layer 5, the copolymerized polycarbonate resin may be used alone or mixed with other resins. Examples of these other resins that can be used include various polycarbonate resins such as bisphenol A type, bisphenol Z type, a bisphenol A type-biphenyl copolymer, and a bisphenol Z type-biphenyl copolymer other than the foregoing copolymerized polycarbonate resin; polyphenylene resins, polyester resins, polyvinyl acetal resins, polyvinyl butyral resins, polyvinyl alcohol resins, vinyl chloride resins, vinyl acetate resins, polyethylene resins, polypropylene resins, acrylic resins, polyurethane resins, epoxy resins, melamine resins, silicone resins, polyamide resins, polystyrene resins, polyacetal resins, polyallylate resins, polysulfone resins, polymers of methacrylic acid esters, and copolymers of these polymers. In addition, resins of the same type having different molecular weights may be used in mixture as well. The content of the resin binder is preferably 10 to 90% by mass, and more preferably 20 to 80% by mass, relative to the solid content of the single layer type photosensitive layer 5.

At least one type of the diester compounds expressed by the general formula (6) needs to be used as the additive for the single layer type photosensitive layer 5. The content of the additive in the single layer type photosensitive layer 5 is preferably 0.05 to 20% by mass, more preferably 0.1 to 15% by mass, and yet more preferably 0.5 to 10% by mass, relative to the solid content of the single layer type photosensitive layer 5.

The film thickness of the single layer type photosensitive layer 5 is preferably in the range of 3 to 100 μm, and more preferably in the range of 5 to 40 μm, in order to maintain the practically effective surface potential.

Positively-Charged Laminated-Type Photoreceptor:

In the positively-charged laminated-type photoreceptor, the charge transport layer 4 is composed mainly of a charge transport material and a resin binder. For the charge transport material and the resin binder of the charge transport layer 4, the same materials as those described regarding the charge transport layer 4 of the negatively-charged laminated-type photoreceptor can be used. The contents of the respective materials and the film thickness of the charge transport layer 4 can also be the same as those of the charge transport layer 4 of the negatively-charged laminated-type photoreceptor. In addition, the copolymerized polycarbonate resin having the structural units expressed by the general formulae (1) and (2) can optionally be used as the resin binder.

The charge generation layer 3 provided on the charge transport layer 4 is composed mainly of a charge generating material, a hole transport material, an electron transport material (acceptor compound), and a resin binder. The same materials as those described regarding the single layer type photosensitive layer 5 in the single layer type photoreceptor can be used as the charge generating material, hole transport material, electron transport material and resin binder of the charge generation layer 3. The contents of the respective materials and the film thickness of the charge generation layer 3 can also be the same as those of the single layer type photosensitive layer 5 of the single layer type photoreceptor.

In the positively charged laminated type photoreceptor, at least one type of the stilbene compound expressed by general formulae (3), (4) and (5) needs to be used as the hole transport material of the charge generation layer 3, and a copolymerized polycarbonate resin having the structural units expressed by the general formulae (1) and (2) as the resin binder of the charge generation layer 3. In addition, at least one type of the diester compounds expressed by the general formula (6) needs to be used as the additive of the charge generation layer 3. Furthermore, if necessary, the compound expressed by the structural formula (6) can be used as the additive of the charge transport layer 4.

In the present invention all of the laminated type and single layer type photosensitive layers can contain degradation inhibitors such as an antioxidant and a light stabilizer, in addition to the additive described above, for the purpose of improving environmental resistance or stability against harmful light. Examples of the compounds used for such purposes include chromanol derivatives such as tocopherol, esterification compounds, polyarylalkane compounds, hydroquinone derivatives, etherification compounds, dietherification compounds, benzophenone derivatives, benzotriazole derivatives, thioether compounds, phenylene diamine derivatives, phosphonic acid esters, phosphorous acid esters, phenol compounds, hindered phenol compounds, linear amine compounds, cyclic amine compounds, and hindered amine compounds.

Moreover, a leveling agent such as silicone oil or fluorine-based oil can be incorporated into the photosensitive layer, for the purpose of improving the leveling property of the formed film or adding lubricity. In addition, for the purposes of regulating the film hardness, reducing the coefficient of friction, and adding lubricity, fine particles of a metal oxide such as silicon oxide (silica), titanium oxide, zinc oxide, calcium oxide, aluminum oxide (alumina), or zirconium oxide, a metal sulfide such as barium sulfate or calcium sulfate, and a metal nitride such as silicon nitride or aluminum nitride, particles of fluorine-based resin such as polytetrafluoroethylene resin, a fluorine-based comb-like graft polymerized resin and the like, may also be included. In addition, if necessary, other known additives can be incorporated without causing a significant impairment in the electrophotographic characteristics.

The method for producing the photoreceptor of the present invention includes a step of applying coating liquid to the conductive substrate to form a photosensitive layer, wherein a material that contains copolymerized polycarbonate resin having the structural units expressed by the general formulae (1) and (2), at least one type of the stilbene compound expressed by the general formulae (3), (4) and (5), and at least one type of the diester compound expressed by the general formula (6), is used as the coating liquid. According to the present invention, various application methods such as an immersion coating method and a spray coating method can be applied to the coating liquid; however, the present invention is not limited thereto.

Applying the photoreceptor for electrophotography of the present invention to various machine processes can lead to the desired effects. Specifically, sufficient effects can be obtained even in the charging processes of contact charging systems using a roller or a brush, and non-contact charging systems using a corotron, a scorotron or the like, as well as in the development processes of contact and non-contact development systems that use non-magnetic one-component, magnetic one-component, and two-component development systems.

Figure 2:
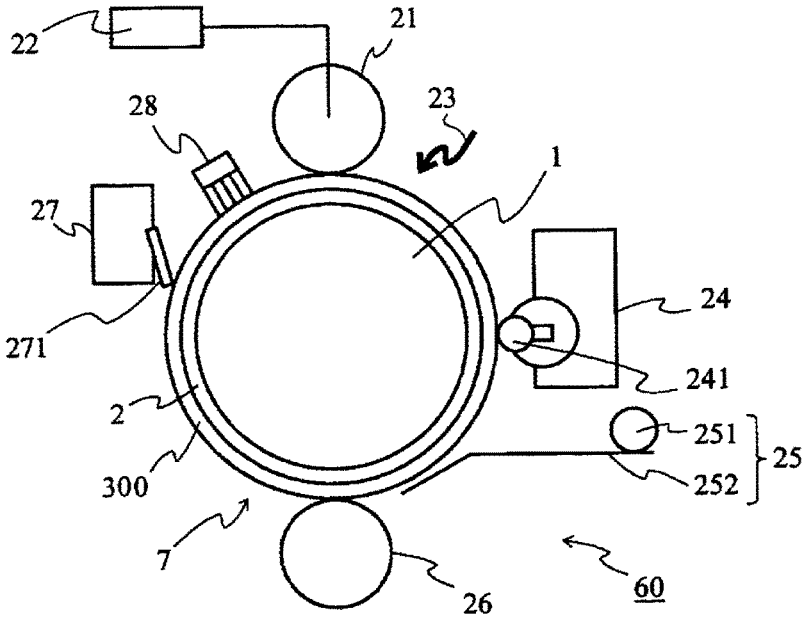
FIG. 2 is a schematic configuration diagram showing an example of an electrophotographic apparatus of the present invention.

For example, FIG. 2 shows a schematic configuration diagram of an electrophotographic apparatus equipped with the photoreceptor for electrophotography of the present invention. The electrophotographic apparatus 60 of the present invention is equipped with a photoreceptor for electrophotography 7 that includes a conductive substrate 1 and an undercoat layer 2 and photosensitive layer 300 that cover the outer circumferential surface of the conductive substrate 1. The electrophotographic apparatus 60 is also configured by a roller charging member 21 disposed in the outer circumferential portion of the photoreceptor 7, a high-voltage power supply 22 that supplies an applied voltage to this roller charging member 21, an image exposure member 23, a developer 24 with a development roller 241, a paper feed member 25 with a paper feed roller 251 and a paper feed guide 252, a transfer charger (direct charging type) 26, a cleaning device 27 with a cleaning blade 271, and a diselectrification member 28. The electrophotographic apparatus 60 of the present invention can be produced as a color printer.

EXAMPLES

Specific embodiments of the present invention are now described hereinafter in more detail by means of Examples; however, the present invention is not intended to be limited to these Examples as long as they do not exceed the gist thereof.

Example 1

An alcohol-soluble nylon (manufactured by Toray Industries, Inc., trade name: "CM8000") in an amount of 3 parts by mass and aminosilane-treated titanium oxide fine particles in an amount of 7 parts by mass were dissolved and dispersed in 90 parts by mass of methanol, thus preparing coating liquid A. This coating liquid A was immersion-coated on the outer circumference of an aluminum cylinder having an outer diameter of 30 mm, which is formed as a conductive substrate 1. The coating liquid on this cylinder was dried at 100° C. for 30 minutes, to obtain an undercoating layer 2 having a film thickness of 3 μm.

Y-type titanyl phthalocyanine in an amount of 1 part by mass as a charge generating material and a polyvinyl butyral resin (manufactured by Sekisui Chemical Co., Ltd., trade name: "S-LEC KS-1") in an mount of 1.5 parts by mass as a resin binder were dissolved and dispersed in 60 parts by mass of dichloromethane, thus preparing coating liquid B. This coating liquid B was immersion-coated on the undercoating layer 2, which was then dried at 80° C. for 30 minutes, forming a charge generation layer 3 having a thickness of 0.25 μm.

The compound expressed by the foregoing formula (3-1) in an amount of 70 parts by mass as a charge transport material, the copolymerized polycarbonate resin expressed by the following formula in an amount of 130 parts by mass (resin (1), with a viscosity average molecular weight of 40,000) as a resin binder, and an additive expressed by the foregoing chemical formula (6-1) in an amount of 10 parts by mass, were dissolved in 1000 parts by mass of dichloromethane, thus preparing coating liquid C. The coating liquid C was immersion-coated on the charge generation layer 3, which was then dried at 90° C. for 60 minutes, forming a charge transport layer 4 having a film thickness of 25 μm. As a result, a negatively-charged laminated type photoreceptor was produced.

Resin (1)

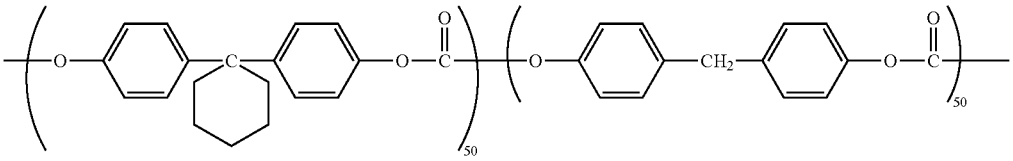

Example 2

A photoreceptor was produced by the same method as the one used in Example 1, except that the additive expressed by the chemical formula (6-1) that was used in Example 1 was replaced with the additive expressed by the chemical formula (6-2).

Example 3

A photoreceptor was produced by the same method as the one used in Example 1, except that the molecular weight of the resin (1) that was used in Example 1 was changed to 50,000 and that the amount of the additive to 0.2 parts by mass.

Example 4

A photoreceptor was produced by the same method as the one used in Example 3, except that the amount of the additive used in Example 3 was changed to 1 part by mass.

Example 5

A photoreceptor was produced by the same method as the one used in Example 3, except that the amount of the additive used in Example 3 was changed to 2 parts by mass.

Example 6

A photoreceptor was produced by the same method as the one used in Example 3, except that the amount of the additive used in Example 3 was changed to 10 parts by mass.

Example 7

A photoreceptor was produced by the same method as the one used in Example 3, except that the amount of the additive used in Example 3 was changed to 20 parts by mass.

Example 8

A photoreceptor was produced by the same method as the one used in Example 3, except that the amount of the additive used in Example 3 was changed to 30 parts by mass.

Example 9

A photoreceptor was produced by the same method as the one used in Example 3, except that the amount of the additive used in Example 3 was changed to 40 parts by mass.

Example 10

A photoreceptor was produced by the same method as the one used in Example 3, except that the additive expressed by the chemical formula (6-1) that is used in Example 3 was replaced with the additive expressed by the chemical formula (6-2).

Example 11

A photoreceptor was produced by the same method as the one used in Example 10, except that the amount of the additive used in Example 10 was changed to 1 part by mass.

Example 12

A photoreceptor was produced by the same method as the one used in Example 10, except that the amount of the additive used in Example 10 was changed to 2 parts by mass.

Example 13

A photoreceptor was produced by the same method as the one used in Example 10, except that the amount of the additive used in Example 10 was changed to 10 parts by mass.

Example 14

A photoreceptor was produced by the same method as the one used in Example 10, except that the amount of the additive used in Example 10 was changed to 20 parts by mass.

Example 15

A photoreceptor was produced by the same method as the one used in Example 10, except that the amount of the additive used in Example 10 was changed to 30 parts by mass.

Example 16

A photoreceptor was produced by the same method as the one used in Example 10, except that the amount of the additive used in Example 10 was changed to 40 parts by mass.

Example 17

A photoreceptor was produced by the same method as the one used in Example 5, except that the additive expressed by the chemical formula (6-2) was added in an amount 2 parts by mass in Example 5.

Example 18

A photoreceptor was produced by the same method as the one used in Example 6, except that the additive expressed by the chemical formula (6-2) was added in an amount 10 parts by mass in Example 6.

Example 19

A photoreceptor was produced by the same method as the one used in Example 7, except that the additive expressed by the chemical formula (6-2) was added in an amount 20 parts by mass in Example 7.

Example 20

A photoreceptor was produced by the same method as the one used in Example 6, except that the amount of the resin (1) used in Example 6 was changed to 140 parts by mass, and the amount of the charge transport material to 60 parts by mass.

Example 21

A photoreceptor was produced by the same method as the one used in Example 13, except that the amount of the resin (1) used in Example 13 was changed to 140 parts by mass, and the amount of the charge transport material to 60 parts by mass.

Example 22

A photoreceptor was produced by the same method as the one used in Example 6, except that the amount of the resin (1) used in Example 6 was changed to 110 parts by mass, and the amount of the charge transport material to 90 parts by mass.

Example 23

A photoreceptor was produced by the same method as the one used in Example 13, except that the amount of the resin (1) used in Example 13 was changed to 110 parts by mass, and the amount of the charge transport material to 90 parts by mass.

Example 24

A photoreceptor was produced by the same method as the one used in Example 1, except that the molecular weight of the resin (1) used in Example 1 was changed to 60,000.

Example 25

A photoreceptor was produced by the same method as the one used in Example 2, except that the molecular weight of the resin (1) used in Example 2 was changed to 60,000.

Example 26

A photoreceptor was produced by the same method as the one used in Example 1, except that the charge transport material used in Example 1 was replaced with the compound expressed by the formula (4-1).

Example 27

A photoreceptor was produced by the same method as the one used in Example 2, except that the charge transport material used in Example 2 was replaced with the compound expressed by the formula (4-1).

Example 28

A photoreceptor was produced by the same method as the one used in Example 3, except that the charge transport material used in Example 3 was replaced with the compound expressed by the formula (4-1).

Example 29

A photoreceptor was produced by the same method as the one used in Example 4, except that the charge transport material used in Example 4 was replaced with the compound expressed by the formula (4-1).

Example 30

A photoreceptor was produced by the same method as the one used in Example 5, except that the charge transport material used in Example 5 was replaced with the compound expressed by the formula (4-1).

Example 31

A photoreceptor was produced by the same method as the one used in Example 6, except that the charge transport material used in Example 6 was replaced with the compound expressed by the formula (4-1).

Example 32

A photoreceptor was produced by the same method as the one used in Example 7, except that the charge transport material used in Example 7 was replaced with the compound expressed by the formula (4-1).

Example 33

A photoreceptor was produced by the same method as the one used in Example 8, except that the charge transport material used in Example 8 was replaced with the compound expressed by the formula (4-1).

Example 34

A photoreceptor was produced by the same method as the one used in Example 9, except that the charge transport material used in Example 9 was replaced with the compound expressed by the formula (4-1).

Example 35

A photoreceptor was produced by the same method as the one used in Example 10, except that the charge transport material used in Example 10 was replaced with the compound expressed by the formula (4-1).

Example 36

A photoreceptor was produced by the same method as the one used in Example 11, except that the charge transport material used in Example 11 was replaced with the compound expressed by the formula (4-1).

Example 37

A photoreceptor was produced by the same method as the one used in Example 12, except that the charge transport material used in Example 12 was replaced with the compound expressed by the formula (4-1).

Example 38

A photoreceptor was produced by the same method as the one used in Example 13, except that the charge transport material used in Example 13 was replaced with the compound expressed by the formula (4-1).

Example 39

A photoreceptor was produced by the same method as the one used in Example 14, except that the charge transport material used in Example 14 was replaced with the compound expressed by the formula (4-1).

Example 40

A photoreceptor was produced by the same method as the one used in Example 15, except that the charge transport material used in Example 15 was replaced with the compound expressed by the formula (4-1).

Example 41

A photoreceptor was produced by the same method as the one used in Example 16, except that the charge transport material used in Example 16 was replaced with the compound expressed by the formula (4-1).

Example 42

A photoreceptor was produced by the same method as the one used in Example 17, except that the charge transport material used in Example 17 was replaced with the compound expressed by the formula (4-1).

Example 43

A photoreceptor was produced by the same method as the one used in Example 18, except that the charge transport material used in Example 18 was replaced with the compound expressed by the formula (4-1).

Example 44

A photoreceptor was produced by the same method as the one used in Example 19, except that the charge transport material used in Example 19 was replaced with the compound expressed by the formula (4-1).

Example 45

A photoreceptor was produced by the same method as the one used in Example 20, except that the charge transport material used in Example 20 was replaced with the compound expressed by the formula (4-1).

Example 46

A photoreceptor was produced by the same method as the one used in Example 21, except that the charge transport material used in Example 21 was replaced with the compound expressed by the formula (4-1).

Example 47

A photoreceptor was produced by the same method as the one used in Example 22, except that the charge transport material used in Example 22 was replaced with the compound expressed by the formula (4-1).

Example 48

A photoreceptor was produced by the same method as the one used in Example 23, except that the charge transport material used in Example 23 was replaced with the compound expressed by the formula (4-1).

Example 49

A photoreceptor was produced by the same method as the one used in Example 24, except that the charge transport material used in Example 24 was replaced with the compound expressed by the formula (4-1).

Example 50

A photoreceptor was produced by the same method as the one used in Example 25, except that the charge transport material used in Example 25 was replaced with the compound expressed by the formula (4-1).

Example 51

A photoreceptor was produced by the same method as the one used in Example 1, except that the resin (1) used in Example 1 was replaced with the resin (2) expressed by the following structural formula (viscosity average molecular weight of 50,000).

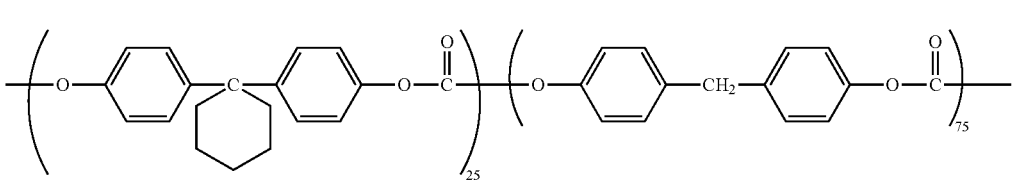

Resin (2)

Example 52

A photoreceptor was produced by the same method as the one used in Example 51, except that the additive expressed by the chemical formula (6-1) used in Example 51 was replaced with the additive expressed by the chemical formula (6-2).

Example 53

A photoreceptor was produced by the same method as the one used in Example 51, except that the charge transport material used in Example 51 was replaced with the compound expressed by the formula (4-1).

Example 54

A photoreceptor was produced by the same method as the one used in Example 52, except that the charge transport material used in Example 52 was replaced with the compound expressed by the formula (4-1).

Example 55

A photoreceptor was produced by the same method as the one used in Example 1, except that the resin (1) used in Example 1 was replaced with the resin (3) expressed by the following structural formula (viscosity average molecular weight of 50,000).

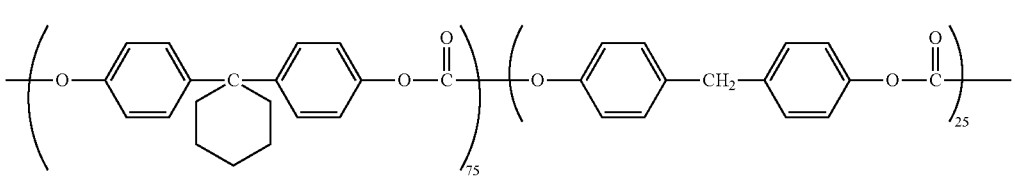

Resin (3)

Example 56

A photoreceptor was produced by the same method as the one used in Example 55, except that the additive expressed by the chemical formula (6-1) used in Example 55 was replaced with the additive expressed by the chemical formula (6-2).

Example 57

A photoreceptor was produced by the same method as the one used in Example 55, except that the charge transport material used in Example 55 was replaced with the compound expressed by the formula (4-1).

Example 58

A photoreceptor was produced by the same method as the one used in Example 55, except that the charge transport material used in Example 56 was replaced with the compound expressed by the formula (4-1).

Comparative Example 1

A photoreceptor was produced by the same method as the one used in Example 1, except that the resin used in Example 1 was replaced with the resin (4) expressed by the following structural formula (viscosity average molecular weight of 50,000).

Resin (4)

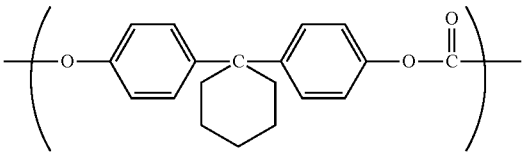

Comparative Example 2

A photoreceptor was produced by the same method as the one used in Example 2, except that the resin used in Example 2 was replaced with the resin (4).

Comparative Example 3

A photoreceptor was produced by the same method as the one used in Example 26, except that the resin used in Example 26 was replaced with the resin (4).

Comparative Example 4

A photoreceptor was produced by the same method as the one used in Example 27, except that the resin used in Example 27 was replaced with the resin (4).

Comparative Example 5

A photoreceptor was produced by the same method as the one used in Comparative Example 1, except that the resin used in Comparative Example 1 was replaced with the resin (5) expressed by the following structural formula (viscosity average molecular weight of 50,000).

Resin (5)

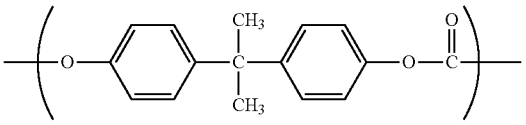

Comparative Example 6

A photoreceptor was produced by the same method as the one used in Comparative Example 2, except that the resin used in Comparative Example 2 was replaced with the resin (5).

Comparative Example 7

A photoreceptor was produced by the same method as the one used in Comparative Example 3, except that the resin used in Comparative Example 3 was replaced with the resin (5).

Comparative Example 8

A photoreceptor was produced by the same method as the one used in Comparative Example 4, except that the resin used in Comparative Example 4 was replaced with the resin (5).

Comparative Example 9

A photoreceptor was produced by the same method as the one used in Comparative Example 6, except that the charge transport material used in Comparative Example 6 was replaced with the compound expressed by the following structural formula (9).

(9)

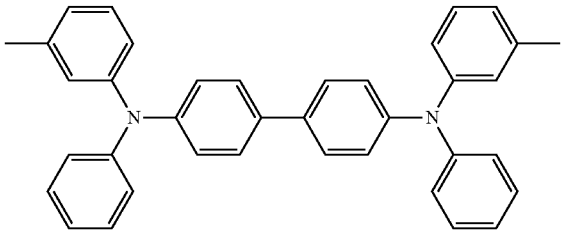

Comparative Example 10

A photoreceptor was produced by the same method as the one used in Example 13, except that the charge transport material used in Example 13 was replaced with the compound expressed by the formula (9).

Comparative Example 11

A photoreceptor was produced by the same method as the one used in Example 6, except that an additive was not added in Example 6.

Comparative Example 12

A photoreceptor was produced by the same method as the one used in Example 35, except that an additive was not added in Example 35.

Example 59

A photoreceptor was produced by the same method as the one used in Example 6, except that the amount of the additive used in Example 6 was changed to 50 parts by mass.

Example 60

A photoreceptor was produced by the same method as the one used in Example 35, except that the amount of the additive used in Example 35 was changed to 50 parts by mass.

TABLE 1

| | Resin | | | Ratio of Charge Transport Material (parts by mass) | | | Ratio of Additive (parts by mass) | |
|---|---|---|---|---|---|---|---|---|
| | Type | Ratio (parts by mass) | Molecular weight | (3-1) | (4-1) | (9) | (6-1) | (6-2) |
| Ex. 1 | Resin (1) | 130 | 40000 | 70 | — | — | 10 | — |
| Ex. 2 | Resin (1) | 130 | 40000 | 70 | — | — | — | 10 |

TABLE 1-continued

| | Resin | | | Ratio of Charge Transport Material (parts by mass) | | | Ratio of Additive (parts by mass) | |
|---|---|---|---|---|---|---|---|---|
| | Type | Ratio (parts by mass) | Molecular weight | (3-1) | (4-1) | (9) | (6-1) | (6-2) |
| Ex. 3 | Resin (1) | 130 | 50000 | 70 | — | — | 0.2 | — |
| Ex. 4 | Resin (1) | 130 | 50000 | 70 | — | — | 1 | — |
| Ex. 5 | Resin (1) | 130 | 50000 | 70 | — | — | 2 | — |
| Ex. 6 | Resin (1) | 130 | 50000 | 70 | — | — | 10 | — |
| Ex. 7 | Resin (1) | 130 | 50000 | 70 | — | — | 20 | — |
| Ex. 8 | Resin (1) | 130 | 50000 | 70 | — | — | 30 | — |
| Ex. 9 | Resin (1) | 130 | 50000 | 70 | — | — | 40 | — |
| Ex. 10 | Resin (1) | 130 | 50000 | 70 | — | — | — | 0.2 |
| Ex. 11 | Resin (1) | 130 | 50000 | 70 | — | — | — | 1 |
| Ex. 12 | Resin (1) | 130 | 50000 | 70 | — | — | — | 2 |
| Ex. 13 | Resin (1) | 130 | 50000 | 70 | — | — | — | 10 |
| Ex. 14 | Resin (1) | 130 | 50000 | 70 | — | — | — | 20 |
| Ex. 15 | Resin (1) | 130 | 50000 | 70 | — | — | — | 30 |
| Ex. 16 | Resin (1) | 130 | 50000 | 70 | — | — | — | 40 |
| Ex. 17 | Resin (1) | 130 | 50000 | 70 | — | — | 2 | 2 |
| Ex. 18 | Resin (1) | 130 | 50000 | 70 | — | — | 10 | 10 |
| Ex. 19 | Resin (1) | 130 | 50000 | 70 | — | — | 20 | 20 |
| Ex. 20 | Resin (1) | 140 | 50000 | 60 | — | — | 10 | — |
| Ex. 21 | Resin (1) | 140 | 50000 | 60 | — | — | — | 10 |
| Ex. 22 | Resin (1) | 110 | 50000 | 90 | — | — | 10 | — |

TABLE 2

| | Resin | | | Ratio of Charge Transport Material (parts by mass) | | | Ratio of Additive (parts by mass) | |
|---|---|---|---|---|---|---|---|---|
| | Type | Ratio (parts by mass) | Molecular weight | (3-1) | (4-1) | (9) | (6-1) | (6-2) |
| Ex. 23 | Resin (1) | 110 | 50000 | 90 | — | — | — | 10 |
| Ex. 24 | Resin (1) | 130 | 60000 | 70 | — | — | 10 | — |
| Ex. 25 | Resin (1) | 130 | 60000 | 70 | — | — | — | 10 |
| Ex. 26 | Resin (1) | 130 | 40000 | — | 70 | — | 10 | — |
| Ex. 27 | Resin (1) | 130 | 40000 | — | 70 | — | — | 10 |
| Ex. 28 | Resin (1) | 130 | 50000 | — | 70 | — | 0.2 | — |
| Ex. 29 | Resin (1) | 130 | 50000 | — | 70 | — | 1 | — |

TABLE 2-continued

| | Resin | | | Ratio of Charge Transport Material (parts by mass) | | | Ratio of Additive (parts by mass) | |
|---|---|---|---|---|---|---|---|---|
| | Type | Ratio (parts by mass) | Molecular weight | (3-1) | (4-1) | (9) | (6-1) | (6-2) |
| Ex. 30 | Resin (1) | 130 | 50000 | — | 70 | — | 2 | — |
| Ex. 31 | Resin (1) | 130 | 50000 | — | 70 | — | 10 | — |
| Ex. 32 | Resin (1) | 130 | 50000 | — | 70 | — | 20 | — |
| Ex. 33 | Resin (1) | 130 | 50000 | — | 70 | — | 30 | — |
| Ex. 34 | Resin (1) | 130 | 50000 | — | 70 | — | 40 | — |
| Ex. 35 | Resin (1) | 130 | 50000 | — | 70 | — | — | 0.2 |
| Ex. 36 | Resin (1) | 130 | 50000 | — | 70 | — | — | 1 |
| Ex. 37 | Resin (1) | 130 | 50000 | — | 70 | — | — | 2 |
| Ex. 38 | Resin (1) | 130 | 50000 | — | 70 | — | — | 10 |
| Ex. 39 | Resin (1) | 130 | 50000 | — | 70 | — | — | 20 |
| Ex. 40 | Resin (1) | 130 | 50000 | — | 70 | — | — | 30 |
| Ex. 41 | Resin (1) | 130 | 50000 | — | 70 | — | — | 40 |
| Ex. 42 | Resin (1) | 130 | 50000 | — | 70 | — | 2 | 2 |
| Ex. 43 | Resin (1) | 130 | 50000 | — | 70 | — | 10 | 10 |
| Ex. 44 | Resin (1) | 130 | 50000 | — | 70 | — | 20 | 20 |

TABLE 3

| | Resin | | | Ratio of Charge Transport Material (parts by mass) | | | Ratio of Additive (parts by mass) | |
|---|---|---|---|---|---|---|---|---|
| | Type | Ratio (parts by mass) | Molecular weight | (3-1) | (4-1) | (9) | (6-1) | (6-2) |
| Ex. 45 | Resin (1) | 140 | 50000 | — | 60 | — | 10 | — |
| Ex. 46 | Resin (1) | 140 | 50000 | — | 60 | — | — | 10 |
| Ex. 47 | Resin (1) | 110 | 50000 | — | 90 | — | 10 | — |
| Ex. 48 | Resin (1) | 110 | 50000 | — | 90 | — | — | 10 |
| Ex. 49 | Resin (1) | 130 | 60000 | — | 70 | — | 10 | — |
| Ex. 50 | Resin (1) | 130 | 60000 | — | 70 | — | — | 10 |
| Ex. 51 | Resin (2) | 130 | 50000 | 70 | — | — | 10 | — |
| Ex. 52 | Resin (2) | 130 | 50000 | 70 | — | — | — | 10 |
| Ex. 53 | Resin (2) | 130 | 50000 | — | 70 | — | 10 | — |
| Ex. 54 | Resin (2) | 130 | 50000 | — | 70 | — | — | 10 |
| Ex. 55 | Resin (3) | 130 | 50000 | 70 | — | — | 10 | — |
| Ex. 56 | Resin (3) | 130 | 50000 | 70 | — | — | — | 10 |
| Ex. 57 | Resin (3) | 130 | 50000 | — | 70 | — | 10 | — |

TABLE 3-continued

| | Resin | | | Ratio of Charge Transport Material (parts by mass) | | | Ratio of Additive (parts by mass) | |
|---|---|---|---|---|---|---|---|---|
| | Type | Ratio (parts by mass) | Molecular weight | (3-1) | (4-1) | (9) | (6-1) | (6-2) |
| Ex. 58 | Resin (3) | 130 | 50000 | — | 70 | — | — | 10 |

TABLE 4

| | Resin | | | Ratio of Charge Transport Material (parts by mass) | | | Ratio of Additive (parts by mass) | |
|---|---|---|---|---|---|---|---|---|
| | Type | Ratio (parts by mass) | Molecular weight | (3-1) | (4-1) | (9) | (6-1) | (6-2) |
| Comp. Ex. 1 | Resin (4) | 130 | 50000 | 70 | — | — | 10 | — |
| Comp. Ex. 2 | Rein (4) | 130 | 50000 | 70 | — | — | — | 10 |
| Comp. Ex. 3 | Resin (4) | 130 | 50000 | — | 70 | — | 10 | — |
| Comp. Ex. 4 | Resin (4) | 130 | 50000 | — | 70 | — | — | 10 |
| Comp. Ex. 5 | Resin (5) | 130 | 50000 | 70 | — | — | 10 | — |
| Comp. Ex. 6 | Resin (5) | 130 | 50000 | 70 | — | — | — | 10 |
| Comp. Ex. 7 | Resin (5) | 130 | 50000 | — | 70 | — | 10 | — |
| Comp. Ex. 8 | Resin (5) | 130 | 50000 | — | 70 | — | — | 10 |
| Comp. Ex. 9 | Resin (1) | 130 | 50000 | — | — | 70 | 10 | — |
| Comp. Ex. 10 | Resin (1) | 130 | 50000 | — | — | 70 | — | 10 |
| Comp. Ex. 11 | Resin (1) | 130 | 50000 | 70 | — | — | — | — |
| Comp. Ex. 12 | Resin (1) | 130 | 50000 | — | 70 | — | — | — |
| Ex. 59 | Resin (1) | 130 | 50000 | 70 | — | — | 50 | — |
| Ex. 60 | Resin (1) | 130 | 50000 | — | 70 | — | — | 50 |

Evaluation of Photoreceptor:

Electrical properties, actual machine characteristics, and solvent crack resistance of the photoreceptors produced in Examples 1 to 60 and Comparative Examples 1 to 12 described above were evaluated by the following methods. The results are shown in the following tables.

Electrical Properties:

For the photoreceptors produced in Examples 1 to 60 and Comparative Examples 1 to 12, the surface of each photoreceptor was charged at −650 V by means of corona discharge in a dark place in an environment at a temperature of 22° C. and a humidity of 50%, and then the surface potential $V_0$ obtained immediately after charging was measured. Subsequently, the photoreceptor was left for 5 seconds in the dark place, and then the surface potential $V_5$ was measured. The potential retention ratio $Vk_5$(%) 5 seconds after the end of charging was calculated according to the following calculation formula (1):

$$Vk_5=V_5/V_0\times 100 \quad (1).$$

Next, using a halogen lamp as a light source, the photoreceptor was irradiated with 1.0 mW/cm$^2$ exposure light which was dispersed to 780 nm using a filter, for 5 seconds starting from the time point when the surface potential reached −600 V. With $E_{1/2}$ (μJ/cm$^2$) representing the amount of exposure that is required in light attenuation until the surface potential reached −300 V was denoted, and with $Vr_5$ (−V) representing the residual potential of the photoreceptor surface obtained 5 seconds after the end of exposure was denoted, these properties were evaluated.

Photoresponsivity:

For the photoreceptors produced in Examples 1 to 60 and Comparative Examples 1 to 12, the surface of each of the photoreceptors was charged at −800 V using Cynthia 93 in a dark place in an environment at a temperature of 5° C. and a humidity of 10%, and then the photoreceptor was rotated (167 rpm) and exposed to light at an intensity of 0.35 μJ/cm$^2$. A surface electrometer was disposed so that the surface potentials of the photoreceptor could be measured 30 ms and 90 ms after the exposure. The difference between the surface potential obtained 90 ms after the exposure and the surface potential obtained 30 ms after the exposure was evaluated as a responsivity.

Actual Machine Characteristics:

Each of the photoreceptors produced in Examples 1 to 60 and Comparative Examples 1 to 12 was placed on a printer LJ4250 manufactured by Hewlett-Packard Company, which had been modified to measure the surface potential of each of the photoreceptors, and the potential of the exposed area of each photoreceptor was evaluated with respect to the usage environments between a low temperature/humidity environment (LL) and a high temperature/humidity environment (HH). In addition, image evaluation (memory evaluation) was also carried out.

Next, the photoreceptors produced in Examples 1 to 60 and Comparative Examples 1 to 12 were placed on a digital copying machine of a two-component development system (Image Runner Color 2880, manufactured by Canon Inc.), which had been modified so that the surface potentials of the photoreceptors could be measured as well. Furthermore, printing was performed on 10,000 A4-size sheets, and the potential of the exposed area (VL) of each photoreceptor before and after the printing was measured, to evaluate potential stability. Moreover, the thicknesses of the photoreceptors before and after the printing were measured, and thereby the amount of wear (μm) after the printing was evaluated. At the same time, image evaluation (memory evaluation) was carried out as well.

Note that the image evaluation was performed in evaluation of printing on each image sample that has checkered flag patterns on the first half portion and halftones on the last half portion, by reading the presence/absence of a memory phenomenon where a checkered flag is displayed in the halftone portion. The one with the memory phenomenon was denoted a circle ○, the one with a slight memory phenomenon a triangle Δ, and the one with no clear memory phenomenon an X. The one with the similar gradations to the original image is determined as (positive), and the one with the opposite gradation as the original image, which is, in other words, the one with inverted images, is determined as (negative).

Solvent Crack Resistance:

Under the same conditions as those of the evaluation of the actual machine characteristics, 10 sheets were printed using the photoreceptors produced in Examples 1 to 60 and Comparative Examples 1 to 12, and then each of the photoreceptors was immersed in kerosene for 60 minutes. Subsequently, a blank sheet was printed under the same conditions, to confirm the presence/absence of printing defects caused due to the presence of cracks. The image results with black stripes were denoted circles ○, and the ones without were denoted X.

These results are shown in the following tables.

TABLE 5

| | $Vk_5$ (%) | $E_{1/2}$ (μJ/cm$^{-2}$) | $Vr_5$ (−V) | Responsivity (difference in potential between 90 ms and 30 ms) (−V) | Actual Machine Characteristics Exposed Area Potentials VL LL*1 (−V) | NN*2 (−V) | HH*3 (−V) | Amount of change in Potential of VL (LL − HH) (−V) | Memory Evaluation in HH | Memory Evaluation in LL |
|---|---|---|---|---|---|---|---|---|---|---|
| Ex. 1 | 96.6 | 0.25 | 35 | 10 | 61 | 49 | 45 | 16 | ○ | ○ |
| Ex. 2 | 96.5 | 0.25 | 36 | 9 | 62 | 47 | 44 | 18 | ○ | ○ |
| Ex. 3 | 96.8 | 0.26 | 35 | 9 | 63 | 52 | 44 | 19 | ○ | ○ |
| Ex. 4 | 96.9 | 0.27 | 35 | 8 | 62 | 52 | 46 | 16 | ○ | ○ |
| Ex. 5 | 96.8 | 0.27 | 36 | 8 | 64 | 52 | 45 | 19 | ○ | ○ |
| Ex. 6 | 96.7 | 0.28 | 36 | 8 | 63 | 50 | 47 | 16 | ○ | ○ |
| Ex. 7 | 96.5 | 0.28 | 38 | 10 | 66 | 53 | 50 | 16 | ○ | ○ |
| Ex. 8 | 96.6 | 0.29 | 40 | 11 | 65 | 52 | 49 | 16 | ○ | ○ |
| Ex. 9 | 96.9 | 0.30 | 40 | 11 | 67 | 54 | 51 | 16 | ○ | ○ |
| Ex. 10 | 96.2 | 0.27 | 36 | 9 | 63 | 49 | 45 | 18 | ○ | ○ |
| Ex. 11 | 96.4 | 0.27 | 37 | 8 | 64 | 51 | 47 | 17 | ○ | ○ |
| Ex. 12 | 96.5 | 0.28 | 36 | 8 | 63 | 50 | 46 | 17 | ○ | ○ |
| Ex. 13 | 96.4 | 0.29 | 36 | 8 | 62 | 52 | 48 | 14 | ○ | ○ |
| Ex. 14 | 96.8 | 0.27 | 37 | 12 | 64 | 53 | 51 | 13 | ○ | ○ |
| Ex. 15 | 96.8 | 0.29 | 39 | 11 | 63 | 51 | 49 | 14 | ○ | ○ |
| Ex. 16 | 96.7 | 0.30 | 40 | 10 | 65 | 54 | 50 | 15 | ○ | ○ |
| Ex. 17 | 96.7 | 0.29 | 37 | 9 | 64 | 52 | 45 | 19 | ○ | ○ |
| Ex. 18 | 96.5 | 0.28 | 38 | 9 | 63 | 50 | 47 | 16 | ○ | ○ |
| Ex. 19 | 96.8 | 0.28 | 39 | 8 | 66 | 53 | 50 | 16 | ○ | ○ |
| Ex. 20 | 96.8 | 0.30 | 40 | 8 | 65 | 52 | 49 | 16 | ○ | ○ |

*1Temperature 5° C., humidity 10%

*2Temperature 25° C., humidity 50%

*3Temperature 35° C., humidity 85%

TABLE 6

| | $Vk_5$ (%) | $E_{1/2}$ (μJ/cm$^{-2}$) | $Vr_5$ (−V) | Responsivity (difference in potential between 90 ms and 30 ms) (−V) | Actual Machine Characteristics Exposed Area Potentials VL LL*1 (−V) | NN*2 (−V) | HH*3 (−V) | Amount of change in Potential of VL (LL − HH) (V) | Memory Evaluation in HH | Memory Evaluation in LL |
|---|---|---|---|---|---|---|---|---|---|---|
| Ex. 21 | 96.9 | 0.31 | 41 | 13 | 64 | 53 | 50 | 14 | ○ | ○ |
| Ex. 22 | 96.8 | 0.26 | 36 | 8 | 60 | 48 | 46 | 14 | ○ | ○ |
| Ex. 23 | 96.9 | 0.25 | 35 | 8 | 61 | 49 | 45 | 16 | ○ | ○ |
| Ex. 24 | 96.5 | 0.29 | 38 | 12 | 65 | 52 | 41 | 24 | ○ | ○ |
| Ex. 25 | 96.5 | 0.30 | 40 | 13 | 64 | 53 | 41 | 23 | ○ | ○ |
| Ex. 26 | 95.9 | 0.30 | 40 | 14 | 66 | 50 | 48 | 18 | ○ | ○ |
| Ex. 27 | 96.0 | 0.32 | 38 | 6 | 67 | 52 | 47 | 20 | ○ | ○ |
| Ex. 28 | 96.5 | 0.30 | 37 | 7 | 67 | 52 | 48 | 19 | ○ | ○ |
| Ex. 29 | 96.0 | 0.29 | 38 | 9 | 66 | 50 | 47 | 19 | ○ | ○ |
| Ex. 30 | 96.4 | 0.30 | 36 | 8 | 66 | 54 | 49 | 17 | ○ | ○ |
| Ex. 31 | 96.5 | 0.32 | 39 | 25 | 65 | 52 | 50 | 15 | ○ | ○ |
| Ex. 32 | 96.0 | 0.31 | 39 | 24 | 69 | 56 | 48 | 21 | ○ | ○ |
| Ex. 33 | 95.9 | 0.33 | 41 | 22 | 64 | 53 | 49 | 15 | ○ | ○ |
| Ex. 34 | 95.8 | 0.35 | 40 | 22 | 68 | 55 | 50 | 18 | ○ | ○ |
| Ex. 35 | 96.0 | 0.28 | 37 | 22 | 64 | 53 | 48 | 16 | ○ | ○ |
| Ex. 36 | 95.8 | 0.29 | 38 | 22 | 69 | 50 | 52 | 17 | ○ | ○ |
| Ex. 37 | 96.5 | 0.29 | 38 | 23 | 65 | 54 | 49 | 16 | ○ | ○ |
| Ex. 38 | 96.5 | 0.29 | 37 | 24 | 68 | 52 | 53 | 15 | ○ | ○ |

TABLE 7

| | $Vk_5$ (%) | $E_{1/2}$ ($\mu J/cm^{-2}$) | $Vr_5$ (−V) | Responsivity (difference in potential between 90 ms and 30 ms) (−V) | Actual Machine Characteristics Exposed Area Potentials VL LL*1 (−V) | NN*2 (−V) | HH*3 (−V) | Amount of change in Potential of VL (LL − HH) (−V) | Memory Evaluation in HH | Memory Evaluation in LL |
|---|---|---|---|---|---|---|---|---|---|---|
| Ex. 39 | 96.3 | 0.30 | 40 | 26 | 69 | 56 | 51 | 18 | ○ | ○ |
| Ex. 40 | 96.4 | 0.31 | 41 | 25 | 70 | 53 | 50 | 20 | ○ | ○ |
| Ex. 41 | 95.9 | 0.32 | 40 | 26 | 71 | 55 | 49 | 22 | ○ | ○ |
| Ex. 42 | 96.4 | 0.31 | 39 | 23 | 67 | 55 | 50 | 17 | ○ | ○ |
| Ex. 43 | 96.0 | 0.33 | 38 | 23 | 67 | 53 | 51 | 16 | ○ | ○ |
| Ex. 44 | 95.7 | 0.34 | 40 | 26 | 71 | 57 | 49 | 22 | ○ | ○ |
| Ex. 45 | 96.5 | 0.32 | 40 | 27 | 68 | 53 | 51 | 17 | ○ | ○ |
| Ex. 46 | 96.7 | 0.33 | 40 | 26 | 70 | 55 | 53 | 17 | ○ | ○ |
| Ex. 47 | 96.5 | 0.26 | 35 | 22 | 64 | 49 | 45 | 19 | ○ | ○ |
| Ex. 48 | 97.0 | 0.28 | 36 | 21 | 65 | 48 | 45 | 20 | ○ | ○ |
| Ex. 49 | 96.8 | 0.33 | 38 | 23 | 73 | 60 | 53 | 20 | ○ | ○ |
| Ex. 50 | 96.3 | 0.33 | 40 | 23 | 71 | 59 | 54 | 17 | ○ | ○ |
| Ex. 51 | 96.7 | 0.30 | 38 | 8 | 65 | 52 | 41 | 24 | ○ | ○ |
| Ex. 52 | 96.8 | 0.29 | 37 | 9 | 65 | 55 | 42 | 23 | ○ | ○ |
| Ex. 53 | 95.8 | 0.31 | 40 | 22 | 68 | 55 | 45 | 23 | ○ | ○ |
| Ex. 54 | 96.3 | 0.33 | 39 | 24 | 65 | 54 | 44 | 21 | ○ | ○ |
| Ex. 55 | 95.9 | 0.32 | 37 | 9 | 65 | 55 | 48 | 17 | ○ | ○ |

TABLE 8

| | $Vk_5$ (%) | $E_{1/2}$ ($\mu J/cm^{-2}$) | $Vr_5$ (−V) | Responsivity (difference in potential between 90 ms and 30 ms) (−V) | Actual Machine Characteristics Exposed Area Potentials VL LL*1 (−V) | NN*2 (−V) | HH*3 (−V) | Amount of change in Potential of VL (LL − HH) (−V) | Memory Evaluation in HH | Memory Evaluation in LL |
|---|---|---|---|---|---|---|---|---|---|---|
| Ex. 56 | 96.2 | 0.33 | 40 | 9 | 63 | 51 | 42 | 21 | ○ | ○ |
| Ex. 57 | 96.8 | 0.32 | 38 | 24 | 67 | 57 | 48 | 19 | ○ | ○ |
| Ex. 58 | 96.3 | 0.30 | 39 | 23 | 68 | 55 | 47 | 21 | ○ | ○ |
| Comp. Ex. 1 | 95.8 | 0.30 | 38 | 10 | 69 | 51 | 46 | 23 | ○ | ○ |
| Comp. Ex. 2 | 96.0 | 0.31 | 37 | 10 | 71 | 50 | 47 | 24 | ○ | ○ |
| Comp. Ex. 3 | 96.3 | 0.32 | 40 | 23 | 70 | 53 | 47 | 23 | ○ | ○ |
| Comp. Ex. 4 | 96.3 | 0.31 | 36 | 25 | 69 | 51 | 48 | 21 | ○ | ○ |
| Comp. Ex. 5 | 96.0 | 0.29 | 36 | 10 | 68 | 50 | 46 | 22 | ○ | ○ |
| Comp. Ex. 6 | 96.3 | 0.32 | 35 | 9 | 70 | 49 | 47 | 23 | ○ | ○ |
| Comp. Ex. 7 | 95.8 | 0.31 | 38 | 23 | 69 | 52 | 46 | 23 | ○ | ○ |
| Comp. Ex. 8 | 96.2 | 0.33 | 39 | 24 | 65 | 53 | 45 | 20 | ○ | ○ |
| Comp. Ex. 9 | 96.3 | 0.35 | 43 | 36 | 83 | 66 | 50 | 33 | ○ | Δ(pos) |
| Comp. Ex. 10 | 95.8 | 0.36 | 44 | 37 | 84 | 64 | 49 | 35 | ○ | Δ(pos) |
| Comp. Ex. 11 | 96.4 | 0.33 | 40 | 10 | 65 | 51 | 43 | 22 | Δ(neg) | ○ |
| Comp. Ex. 12 | 96.3 | 0.31 | 39 | 24 | 66 | 50 | 46 | 20 | Δ(neg) | ○ |
| Ex. 59 | 96.4 | 0.33 | 40 | 11 | 63 | 51 | 43 | 20 | ○ | ○ |
| Ex. 60 | 96.3 | 0.31 | 39 | 23 | 67 | 50 | 46 | 21 | ○ | ○ |

TABLE 9

| | Initial Exposed Area Potential Before Copying Starts (−V) | Initial Image Memory Evaluation | Exposed Area Potential After Copying 100K (−V) | Amount of Change in Exposed Area Potential (−V) | Image Memory Evaluation After Repeated Printing | Degree of Film Scraping of Photosensitive Layer Before/After Copying (μM) | Solvent Crack Resistance |
|---|---|---|---|---|---|---|---|
| Ex. 1 | 62 | ○ | 40 | 22 | ○ | 2.70 | ○ |
| Ex. 2 | 60 | ○ | 39 | 21 | ○ | 2.65 | ○ |
| Ex. 3 | 59 | ○ | 38 | 21 | ○ | 2.60 | ○ |
| Ex. 4 | 61 | ○ | 39 | 22 | ○ | 2.69 | ○ |
| Ex. 5 | 59 | ○ | 40 | 19 | ○ | 2.70 | ○ |
| Ex. 6 | 60 | ○ | 38 | 22 | ○ | 2.72 | ○ |
| Ex. 7 | 60 | ○ | 40 | 20 | ○ | 2.49 | ○ |
| Ex. 8 | 59 | ○ | 40 | 19 | ○ | 2.49 | ○ |
| Ex. 9 | 59 | ○ | 41 | 18 | ○ | 2.50 | ○ |
| Ex. 10 | 58 | ○ | 39 | 19 | ○ | 2.47 | ○ |
| Ex. 11 | 60 | ○ | 41 | 19 | ○ | 2.30 | ○ |
| Ex. 12 | 60 | ○ | 40 | 20 | ○ | 2.50 | ○ |
| Ex. 13 | 61 | ○ | 43 | 18 | ○ | 2.45 | ○ |
| Ex. 14 | 56 | ○ | 40 | 18 | ○ | 2.50 | ○ |

TABLE 10

| | Initial Exposed Area Potential Before Copying Starts (−V) | Initial Image Memory Evaluation | Exposed Area Potential After Copying 100K (−V) | Amount of Change in Exposed Area Potential (−V) | Image Memory Evaluation After Repeated Printing | Degree of Film Scraping of Photosensitive Layer Before/After Copying (μM) | Solvent Crack Resistance |
|---|---|---|---|---|---|---|---|
| Ex. 15 | 47 | ○ | 42 | 5 | ○ | 2.44 | ○ |
| Ex. 16 | 51 | ○ | 47 | 4 | ○ | 2.30 | ○ |
| Ex. 17 | 49 | ○ | 44 | 5 | ○ | 2.50 | ○ |
| Ex. 18 | 48 | ○ | 42 | 6 | ○ | 2.47 | ○ |
| Ex. 19 | 50 | ○ | 47 | 3 | ○ | 2.30 | ○ |
| Ex. 20 | 52 | ○ | 49 | 3 | ○ | 2.28 | ○ |
| Ex. 21 | 51 | ○ | 45 | 6 | ○ | 2.25 | ○ |
| Ex. 22 | 47 | ○ | 43 | 4 | ○ | 2.50 | ○ |
| Ex. 23 | 45 | ○ | 44 | 1 | ○ | 2.52 | ○ |
| Ex. 24 | 48 | ○ | 46 | 2 | ○ | 2.40 | ○ |
| Ex. 25 | 54 | ○ | 48 | 6 | ○ | 2.45 | ○ |
| Ex. 26 | 53 | ○ | 47 | 6 | ○ | 2.63 | ○ |
| Ex. 27 | 53 | ○ | 49 | 4 | ○ | 2.65 | ○ |
| Ex. 28 | 51 | ○ | 46 | 5 | ○ | 2.47 | ○ |
| Ex. 29 | 54 | ○ | 48 | 6 | ○ | 2.46 | ○ |
| Ex. 30 | 53 | ○ | 47 | 6 | ○ | 2.44 | ○ |
| Ex. 31 | 54 | ○ | 47 | 7 | ○ | 2.41 | ○ |
| Ex. 32 | 55 | ○ | 49 | 6 | ○ | 2.38 | ○ |
| Ex. 33 | 50 | ○ | 44 | 6 | ○ | 2.40 | ○ |

TABLE 11

| | Initial Exposed Area Potential Before Copying Starts (−V) | Initial Image Memory Evaluation | Exposed Area Potential After Copying 100K (−V) | Amount of Change in Exposed Area Potential (−V) | Image Memory Evaluation After Repeated Printing | Degree of Film Scraping of Photosensitive Layer Before/After Copying (μM) | Solvent Crack Resistance |
|---|---|---|---|---|---|---|---|
| Ex. 34 | 53 | ○ | 48 | 5 | ○ | 2.39 | ○ |
| Ex. 35 | 53 | ○ | 46 | 7 | ○ | 2.51 | ○ |
| Ex. 36 | 55 | ○ | 49 | 6 | ○ | 2.42 | ○ |
| Ex. 37 | 55 | ○ | 50 | 5 | ○ | 2.50 | ○ |
| Ex. 38 | 54 | ○ | 49 | 5 | ○ | 2.39 | ○ |
| Ex. 39 | 53 | ○ | 47 | 6 | ○ | 2.42 | ○ |
| Ex. 40 | 53 | ○ | 46 | 7 | ○ | 2.40 | ○ |
| Ex. 41 | 55 | ○ | 50 | 5 | ○ | 2.43 | ○ |
| Ex. 42 | 55 | ○ | 50 | 5 | ○ | 2.45 | ○ |

TABLE 11-continued

| | Initial Exposed Area Potential Before Copying Starts (−V) | Initial Image Memory Evaluation | Exposed Area Potential After Copying 100K (−V) | Amount of Change in Exposed Area Potential (−V) | Image Memory Evaluation After Repeated Printing | Degree of Film Scraping of Photosensitive Layer Before/After Copying (μM) | Solvent Crack Resistance |
|---|---|---|---|---|---|---|---|
| Ex. 43 | 53 | ○ | 49 | 4 | ○ | 2.40 | ○ |
| Ex. 44 | 58 | ○ | 53 | 5 | ○ | 2.40 | ○ |
| Ex. 45 | 55 | ○ | 49 | 6 | ○ | 2.43 | ○ |
| Ex. 46 | 54 | ○ | 47 | 7 | ○ | 2.45 | ○ |
| Ex. 47 | 48 | ○ | 43 | 5 | ○ | 2.60 | ○ |
| Ex. 48 | 48 | ○ | 44 | 4 | ○ | 2.59 | ○ |
| Ex. 49 | 54 | ○ | 51 | 3 | ○ | 2.28 | ○ |
| Ex. 50 | 56 | ○ | 54 | 2 | ○ | 2.30 | ○ |
| Ex. 51 | 54 | ○ | 52 | 2 | ○ | 2.40 | ○ |
| Ex. 52 | 54 | ○ | 49 | 5 | ○ | 2.38 | ○ |

TABLE 12

| | Initial Exposed Area Potential Before Copying Starts (−V) | Initial Image Memory Evaluation | Exposed Area Potential After Copying 100K (−V) | Amount of Change in Exposed Area Potential (−V) | Image Memory Evaluation After Repeated Printing | Degree of Film Scraping of Photosensitive Layer Before/After Copying (μM) | Solvent Crack Resistance |
|---|---|---|---|---|---|---|---|
| Ex. 53 | 55 | ○ | 48 | 7 | ○ | 2.28 | ○ |
| Ex. 54 | 56 | ○ | 50 | 6 | ○ | 2.30 | ○ |
| Ex. 55 | 56 | ○ | 54 | 2 | ○ | 2.55 | ○ |
| Ex. 56 | 53 | ○ | 52 | 1 | ○ | 2.50 | ○ |
| Ex. 57 | 56 | ○ | 49 | 7 | ○ | 2.40 | ○ |
| Ex. 58 | 59 | ○ | 53 | 6 | ○ | 2.40 | ○ |
| Comp. Ex. 1 | 61 | ○ | 56 | 5 | ○ | 3.38 | X |
| Comp. Ex. 2 | 60 | ○ | 54 | 6 | ○ | 3.40 | X |
| Comp. Ex. 3 | 63 | ○ | 61 | 2 | ○ | 3.39 | X |
| Comp. Ex. 4 | 60 | ○ | 52 | 8 | ○ | 3.33 | X |
| Comp. Ex. 5 | 59 | ○ | 55 | 4 | Δ(neg) | 5.00 | Δ |
| Comp. Ex. 6 | 58 | ○ | 56 | 2 | Δ(neg) | 5.02 | Δ |
| Comp. Ex. 7 | 54 | ○ | 48 | 6 | Δ(neg) | 5.04 | Δ |
| Comp. Ex. 8 | 53 | ○ | 50 | 3 | Δ(neg) | 5.10 | Δ |
| Comp. Ex. 9 | 55 | ○ | 53 | 2 | Δ(neg) | 2.63 | X |
| Comp. Ex. 10 | 74 | ○ | 65 | 9 | Δ(neg) | 2.60 | X |
| Comp. Ex. 11 | 52 | ○ | 46 | 6 | ○ | 2.90 | ○ |
| Comp. Ex. 12 | 54 | ○ | 48 | 6 | ○ | 2.80 | ○ |
| Ex. 59 | 52 | ○ | 44 | 8 | ○ | 3.19 | Δ |
| Ex. 60 | 54 | ○ | 45 | 9 | ○ | 3.23 | Δ |

As can be seen from the results in the tables above, it is clear that the use of a combination of a resin binder, a charge transport material, and an additive in the present invention realized higher sensitivity and lower residual potentials than Comparative Examples 1 to 10 for the initial electrical properties. It is also clear that the use of the additive in the present invention hardly caused significant fluctuations in the initial sensitivities, compared to Comparative Examples 11 and 12 in which no additives were used.

It is also clear from the results in the tables above that the use of a combination of a resin binder, a charge transport material, and an additive in the present invention reduced the environmental dependency of the potentials or images and significantly improved the memories in the low temperature/humidity environment in particular.

According to the results in the tables above, it was confirmed that the use of a combination of a resin binder, a charge transport material, and an additive in the present invention achieved excellent initial electrical properties and potential characteristics in the various environments, in durability printing, showed stable potential transitions without any effects of ozone, NOx and the like in the apparatus, reduced the changes in potential and the degree of film scraping, and obtained favorable solvent crack resistance.

Therefore, the use of a combination of a resin binder, a charge transport material, and an additive according to the present invention can obtain an excellent photoreceptor for electrophotography with less amount of wear, without impairing the electrical properties thereof.

What is claimed is:

1. A photoreceptor for electrophotography, comprising:

a conductive substrate; and a photosensitive layer that is provided on the conductive substrate and that contains at least:

a resin binder comprised of a polycarbonate resin formed from a copolymer having structural units expressed by general formulae (1) and (2) below;

a charge transport material comprised of at least one type of stilbene compound expressed by general formula (3) below, and an additive comprised of at least one type of diester compound expressed by general formula (6) below:

(1)

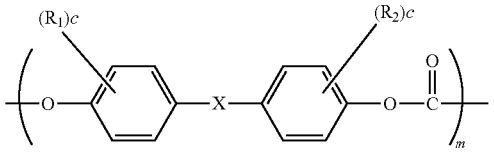

(2)

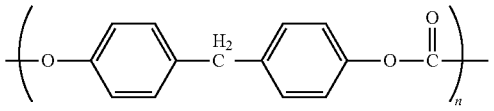

where, in general formula (1), $R_1$ and $R_2$ may be identical or different and each represents a hydrogen atom, an alkyl group having 1 to 12 carbon atoms, a halogen atom, a substituted or non-substituted aryl group having 6 to 12 carbon atoms, or an alkoxy group having 1 to 12 carbon atoms, c is an integer of 0 to 4, X is a single bond, —O—, —S—, —SO—, —CO—, —$SO_2$—, or $CR_3R_4$— (in which $R_3$ and $R_4$ may be identical or different and each represents a hydrogen atom, an alkyl group having 1 to 12 carbon atoms, a halogenated alkyl group, or a substituted or non-substituted aryl group having 6 to 12 carbon atoms), a substituted or non-substituted cycloalkylidene group having 5 to 12 carbon atoms, a substituted or non-substituted a w alkylene group having 2 to 12 carbon atoms, a -9,9-fluorenylidene group, a substituted or non-substituted arylene group having 6 to 12 carbon atoms, or a bivalent radical containing an aryl group or arylene group having 6 to 12 carbon atoms, and m and n represent mole fractions of monomers, respectively, (3)

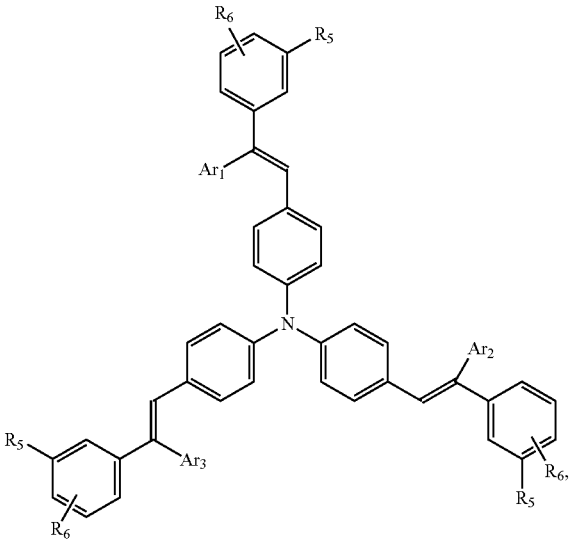

where, in general formula (3), $R_5$ and $R_6$ may be identical or different and each represents a substituted or an unsubstituted alkyl group, or a methoxy group, and $Ar_1$, $Ar_2$, and $Ar_3$ each represents hydrogen, (6)

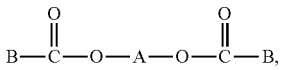

where, in general formula (6), A is any organic group represented by formula (7) below, and B is any organic group represented by formula (8) below, (7)

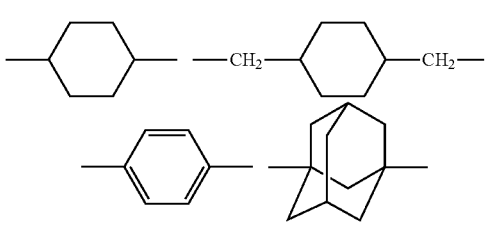

(8)

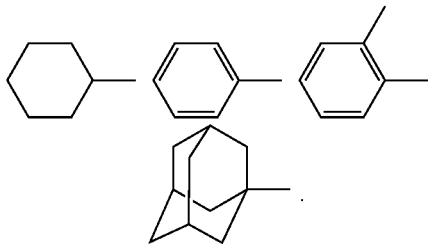

2. The photoreceptor for electrophotography according to claim 1, wherein the photosensitive layer is configured as an outermost layer of the photoreceptor.

3. The photoreceptor for electrophotography according to claim 1, wherein the photosensitive layer is configured by sequentially stacking a charge generation layer and a charge transport layer, and wherein the charge transport layer contains the polycarbonate resin, the stilbene compound, and the diester compound.

4. The photoreceptor for electrophotography according to claim 1, wherein $R_1$ and $R_2$ in general formula (1) each independently represents a hydrogen atom or a methyl group and X is a cyclohexylidene group.

5. The photoreceptor for electrophotography according to claim 1, wherein the copolymer has a ratio of the structural unit expressed by general formula (1) to the structural unit expressed by general formula (2) such that the structural unit expressed by general formula (1) is equal to or greater than 15 mol % but equal to or less than 90 mol %.

6. The photoreceptor for electrophotography according to claim 1, wherein the photosensitive layer contains from 0.05% by mass to 20% by mass of the diester compound relative to a total solid content thereof.

7. In an electrophotographic apparatus, the improvement comprising including the photoreceptor for electrophotography according to claim 1.

8. A method for manufacturing the photoreceptor for electrophotography according to claim 1, the method comprising:

providing a coating liquid comprised of:

a polycarbonate resin comprising a copolymer having structural units expressed by general formulas (1) and (2);

at least one type of stilbene compound expressed by general formula (3) below; and at least one type of diester compound expressed by general formula (6):

(1)

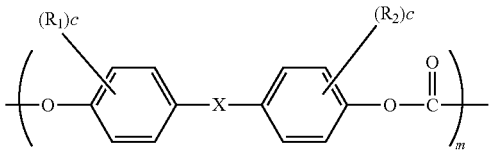

(2)

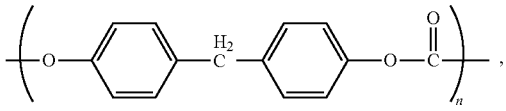

where, in general formula (1), $R_1$ and $R_2$ may be identical or different and each represents a hydrogen atom, an alkyl group having 1 to 12 carbon atoms, a halogen atom, a substituted or non-substituted aryl group having 6 to 12 carbon atoms, or an alkoxy group having 1 to 12 carbon atoms, c is an integer of 0 to 4, X is a single bond, —O—, —S—, —SO—, —CO—, —$SO_2$—, or $CR_3R_4$— (in which $R_3$ and $R_4$ may be identical or different and each represents a hydrogen atom, an alkyl group having 1 to 12 carbon atoms, a halogenated alkyl group, or a substituted or non-substituted aryl group having 6 to 12 carbon atoms), a substituted or non-substituted cycloalkylidene group having 5 to 12 carbon atoms, a substituted or non-substituted a w alkylene group having 2 to 12 carbon atoms, a -9,9-fluorenylidene group, a substituted or non-substituted arylene group having 6 to 12 carbon atoms, or a bivalent radical containing an aryl group or arylene group having 6 to 12 carbon atoms, and m, n represent mole fractions of monomers, respectively, (3)

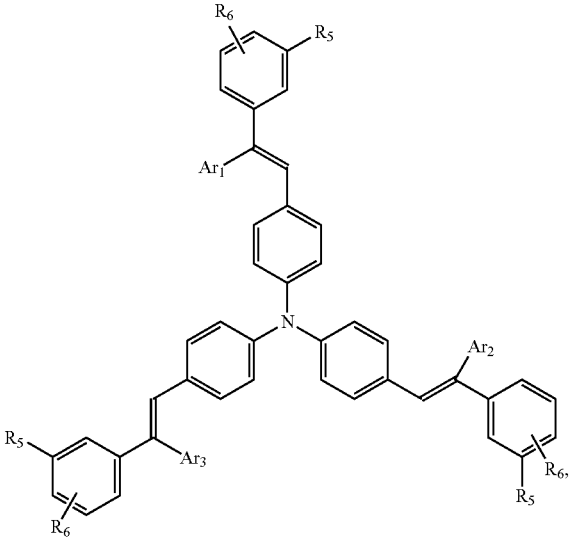

where, in general formula (3), $R_5$ and $R_6$ each represents a methoxy group, and $Ar_1$, $Ar_2$, and $Ar_3$ may be identical or different and each represents a hydrogen group or a substituted or unsubstituted aryl group, and (6)

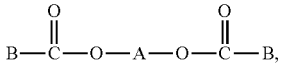

where, in general formula (6), A is any organic group represented by formula (7) below, and B is any organic group represented by formula (8) below, (7)

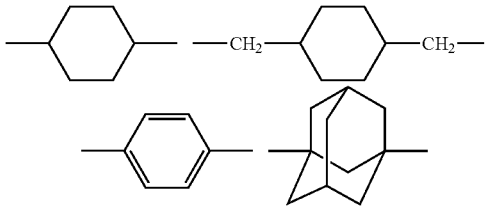

(8)

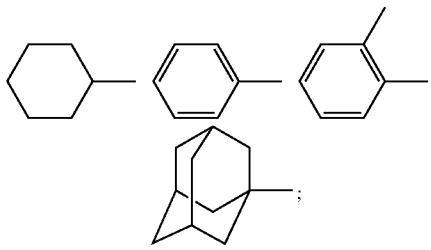

and applying the coating liquid onto a conductive substrate to form a photosensitive layer.

* * * * *